US006601687B1

(12) United States Patent
Jenrick et al.

(10) Patent No.: US 6,601,687 B1
(45) Date of Patent: Aug. 5, 2003

(54) CURRENCY HANDLING SYSTEM HAVING MULTIPLE OUTPUT RECEPTACLES

(75) Inventors: Charles P. Jenrick, Chicago, IL (US); Robert J. Klein, Chicago, IL (US); Curtis W. Hallowell, Palatine, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 139 days.

(21) Appl. No.: 09/688,538

(22) Filed: Oct. 16, 2000

Related U.S. Application Data

(63) Continuation-in-part of application No. 09/502,666, filed on Feb. 11, 2000.

(51) Int. Cl.[7] ..... G07C 3/00; G07F 7/04

(52) U.S. Cl. ..... 194/206; 194/200; 209/534; 221/242; 271/158; 271/181

(58) Field of Search ..... 194/200, 206, 194/207; 209/534; 271/31.1, 149, 157, 158, 180, 181; 221/242

(56) References Cited

U.S. PATENT DOCUMENTS

| | | | | |
|---|---|---|---|---|
| 3,245,534 | A | 4/1966 | Smith et al. | 382/7 |
| 3,246,295 | A | 4/1966 | DeClaris et al. | 382/56 |
| 3,280,974 | A | 10/1966 | Riddle et al. | 209/111.8 |
| 3,443,107 | A | 5/1969 | D. Modglin | 250/219 |
| 3,480,785 | A | 11/1969 | Aufderheide | 250/219 |
| 3,496,370 | A | 2/1970 | Haville et al. | 250/219 |
| 3,509,535 | A | 4/1970 | Berube | 340/149 |
| 3,612,835 | A | 10/1971 | Andrews et al. | 235/61.11 D |
| 3,618,765 | A | 11/1971 | Cooper et al. | 209/534 |
| 3,679,314 | A | 7/1972 | Mustert | 356/71 |
| 3,764,899 | A | 10/1973 | Peterson et al. | 324/61 R |
| 3,778,628 | A | 12/1973 | Novak et al. | 250/556 |
| 3,815,021 | A | 6/1974 | Kerr | 324/61 R |
| 3,842,281 | A | 10/1974 | Goodrich | 250/461 |
| 3,870,629 | A | 3/1975 | Carter et al. | 209/111.8 |
| 3,906,449 | A | 9/1975 | Marchak | 340/146.3 R |

(List continued on next page.)

FOREIGN PATENT DOCUMENTS

| | | |
|---|---|---|
| DE | 2659929 | 5/1976 |
| DE | 2935668 A1 | 9/1979 |

(List continued on next page.)

OTHER PUBLICATIONS

U.S. patent application Ser. No. 09/502,666, Jenrick et al., filed Feb. 11, 2000.

U.S. patent application Ser. No. 09/503,039, Klein et al., Feb. 11, 2000.

U.S. patent application Ser. No. 09/635,181, Hallowell filed Aug. 09, 2000.

(List continued on next page.)

*Primary Examiner*—Eileen D. Lillis
*Assistant Examiner*—Thuy V. Tran
(74) *Attorney, Agent, or Firm*—Jenkens & Gilchrist

(57) ABSTRACT

A currency handling device for rapidly processing a plurality of currency bills comprises an input receptacle adapted to receive the currency bills to be processed, a plurality of output receptacles adapted to receive the bills after the bills have been processed, a transport mechanism adapted to transport the bills, one at a time, along a transport path from the input receptacle to the plurality of output receptacles, an evaluating unit that is adapted to determine information concerning the bills, and a controller. The evaluation unit includes at least one sensor positioned along the transport path between the input receptacle and the plurality of output receptacles. The controller is adapted to operate the currency handling device according to a mode of operation wherein the mode of operation designates the output receptacle to which each of the bills are transported based on the determined information concerning the bill. The controller is adapted to disable at least one of the plurality of output receptacles. The controller is adapted to cause the transport mechanism to direct bills directed to the disabled one of the plurality of output receptacles pursuant to the mode of operation to an alternative output receptacle.

24 Claims, 28 Drawing Sheets

U.S. PATENT DOCUMENTS

| | | | | |
|---|---|---|---|---|
| 3,976,198 | A | 8/1976 | Carnes, Jr. et al. | 209/111.7 T |
| 4,041,456 | A | 8/1977 | Ott et al. | 340/146.3 R |
| 4,081,131 | A | 3/1978 | Sand et al. | 235/419 |
| 4,096,991 | A | 6/1978 | Iquchi | 235/419 |
| 4,114,804 | A | 9/1978 | Jones et al. | 235/476 |
| 4,147,430 | A | 4/1979 | Gorgone et al. | 356/51 |
| 4,164,770 | A | 8/1979 | Jeffers | 360/113 |
| 4,167,458 | A | 9/1979 | Louzos et al. | 204/14 |
| 4,179,685 | A | 12/1979 | O'Maley | 340/146.3 |
| 4,236,639 | A | * 12/1980 | Boettge et al. | 209/534 |
| 4,250,806 | A | 2/1981 | Boyson et al. | 101/2 |
| 4,255,651 | A | 3/1981 | Phillips | 235/92 |
| 4,275,874 | A | 6/1981 | DiBlasio | 271/4 |
| 4,277,774 | A | 7/1981 | Fuji et al. | 340/146.3 |
| 4,283,708 | A | 8/1981 | Lee | 340/146.32 |
| 4,288,781 | A | 9/1981 | Sellner et al. | 340/146.3 |
| 4,302,781 | A | 11/1981 | Ikeda et al. | 358/486 |
| 4,311,914 | A | 1/1982 | Huber | 250/556 |
| 4,313,598 | A | 2/1982 | DiBlasio | 271/124 |
| 4,332,348 | A | 6/1982 | Nordin | 232/43.3 |
| 4,334,619 | A | 6/1982 | Horino et al. | 209/551 |
| 4,348,656 | A | 9/1982 | Gorgone et al. | 340/146.3 R |
| 4,349,111 | A | 9/1982 | Shah et al. | 209/534 |
| 4,352,988 | A | 10/1982 | Ishida | 250/559 |
| 4,355,300 | A | 10/1982 | Weber | 340/146.3 C |
| 4,356,473 | A | 10/1982 | Freudenthal | 340/146.3 H |
| 4,357,528 | A | 11/1982 | Smith et al. | 235/92 |
| 4,365,700 | A | 12/1982 | Arimato et al. | 194/2 |
| 4,376,364 | A | 3/1983 | Horino et al. | 53/54 |
| 4,381,447 | A | 4/1983 | Horvath et al. | 250/223 |
| 4,386,432 | A | 5/1983 | Nakamura et al. | 382/7 |
| 4,388,662 | A | 6/1983 | Jeffers et al. | 360/113 |
| 4,398,088 | A | 8/1983 | Hirose et al. | 235/379 |
| 4,413,296 | A | 11/1983 | Jeffers | 360/113 |
| 4,442,541 | A | 4/1984 | Finkel et al. | 382/7 |
| 4,458,816 | A | 7/1984 | Horino et al. | 209/548 |
| 4,461,028 | A | 7/1984 | Okubo | 382/15 |
| 4,464,786 | A | 8/1984 | Nishito et al. | 382/7 |
| 4,464,787 | A | 8/1984 | Fish et al. | 382/7 |
| 4,470,496 | A | 9/1984 | Steiner | 914/4 C |
| 4,470,590 | A | 9/1984 | Ariga et al. | 271/187 |
| RE31,692 | E | 10/1984 | Tyburski et al. | 382/7 |
| 4,479,049 | A | 10/1984 | Hirose | 235/279 |
| 4,480,177 | A | 10/1984 | Allen | 235/379 |
| 4,482,058 | A | 11/1984 | Steiner | 209/534 |
| 4,487,306 | A | 12/1984 | Nao et al. | 382/135 |
| 4,490,846 | A | 12/1984 | Ishida et al. | 382/7 |
| 4,501,418 | A | 2/1985 | Ariga et al. | 271/187 |
| 4,503,963 | A | 3/1985 | Steiner | |
| 4,513,439 | A | 4/1985 | Gorgone et al. | 382/7 |
| 4,532,641 | A | 7/1985 | Nishimura | 377/14 |
| 4,539,702 | A | 9/1985 | Oka | 382/7 |
| 4,542,829 | A | 9/1985 | Emery et al. | 209/534 |
| 4,547,896 | A | 10/1985 | Ohtombe et al. | 382/318 |
| 4,553,846 | A | 11/1985 | Hilton et al. | 356/429 |
| 4,556,140 | A | 12/1985 | Okada | 194/4 |
| 4,557,597 | A | 12/1985 | Iwama | 356/71 |
| 4,558,224 | A | 12/1985 | Gober | 250/460.1 |
| 4,559,451 | A | 12/1985 | Curl | 250/560 |
| 4,559,452 | A | 12/1985 | Igaki et al. | 250/560 |
| 4,563,771 | A | 1/1986 | Gorgone et al. | 382/7 |
| 4,567,370 | A | 1/1986 | Falls | 250/461.1 |
| 4,585,928 | A | 4/1986 | Watanabe | 235/379 |
| 4,587,412 | A | 5/1986 | Apisdorf | 235/449 |
| 4,587,434 | A | 5/1986 | Roes et al. | 250/556 |
| 4,592,090 | A | 5/1986 | Curl et al. | 382/7 |
| 4,593,184 | A | 6/1986 | Bryce et al. | 235/449 |
| 4,611,345 | A | 9/1986 | Ohniski et al. | 382/7 |
| 4,625,870 | A | 12/1986 | Nao et al. | 209/534 |
| 4,628,194 | A | 12/1986 | Dobbins et al. | 235/379 |
| 4,629,382 | A | 12/1986 | Ueshin | 414/48 |
| 4,638,988 | A | 1/1987 | Kershaw | |
| 4,645,936 | A | 2/1987 | Gorgone | 250/556 |
| 4,653,647 | A | 3/1987 | Hashimoto | 209/534 |
| 4,658,289 | A | 4/1987 | Nagano et al. | 358/75 |
| 4,677,682 | A | 6/1987 | Miyaqawa et al. | 382/7 |
| 4,681,229 | A | 7/1987 | Uesaka et al. | 209/534 |
| 4,683,508 | A | 7/1987 | Jeffers et al. | 360/113 |
| 4,690,268 | A | 9/1987 | Ueshin | 198/399 |
| 4,694,963 | A | 9/1987 | Takesako | 209/534 |
| 4,697,071 | A | 9/1987 | Hiraoka et al. | 235/379 |
| 4,700,368 | A | 10/1987 | Munn et al. | 377/8 |
| 4,707,843 | A | 11/1987 | McDonald et al. | 377/8 |
| 4,716,456 | A | 12/1987 | Hosaka | 358/75 |
| 4,733,308 | A | 3/1988 | Nakamura et al. | 358/496 |
| 4,747,492 | A | 5/1988 | Saito et al. | 209/534 |
| 4,749,087 | A | 6/1988 | Buttifant | 382/7 |
| 4,764,976 | A | 8/1988 | Kallin et al. | 382/65 |
| 4,784,274 | A | 11/1988 | Mori et al. | |
| 4,804,998 | A | 2/1989 | Miyawaki | |
| 4,817,176 | A | 3/1989 | Marshall et al. | 382/43 |
| 4,820,909 | A | 4/1989 | Kawaucki et al. | 235/379 |
| 4,823,393 | A | 4/1989 | Kawakami | 382/7 |
| 4,825,246 | A | 4/1989 | Fukuchi et al. | 355/4 |
| 4,827,531 | A | 5/1989 | Milford | 382/7 |
| 4,834,230 | A | 5/1989 | Kondo et al. | 194/206 |
| 4,841,358 | A | 6/1989 | Kammato et al. | 358/75 |
| 4,875,670 | A | 10/1989 | Petersen et al. | |
| 4,881,268 | A | 11/1989 | Uchida et al. | 382/7 |
| 4,905,840 | A | 3/1990 | Yuge et al. | 209/534 |
| 4,906,988 | A | 3/1990 | Copella | 340/825 |
| 4,908,516 | A | 3/1990 | West | 250/556 |
| 4,917,371 | A | 4/1990 | Bastow et al. | |
| 4,973,851 | A | 11/1990 | Lee | 250/556 |
| 4,984,280 | A | 1/1991 | Abe | 382/7 |
| 4,984,692 | A | 1/1991 | Obara | 209/583 |
| 4,985,614 | A | 1/1991 | Pease et al. | 235/440 |
| 4,992,860 | A | 2/1991 | Hamaquchi et al. | 358/75 |
| 4,996,604 | A | 2/1991 | Oqawa et al. | 358/486 |
| 5,012,932 | A | 5/1991 | Omura et al. | 209/534 |
| 5,020,787 | A | 6/1991 | Arikawa | 271/3 |
| 5,027,415 | A | 6/1991 | Hara et al. | 382/135 |
| 5,047,871 | A | 9/1991 | Meyer et al. | 358/486 |
| 5,054,621 | A | 10/1991 | Murphy et al. | 209/534 |
| 5,055,834 | A | 10/1991 | Chiba | 382/135 |
| 5,068,519 | A | 11/1991 | Bryce | 235/449 |
| 5,076,441 | A | 12/1991 | Gerlier | 209/534 |
| 5,105,364 | A | 4/1992 | Kkawamura et al. | 364/478 |
| 5,119,025 | A | 6/1992 | Smith et al. | 324/252 |
| 5,122,754 | A | 6/1992 | Gotaas | 324/676 |
| 5,146,067 | A | 9/1992 | Sloan et al. | 235/381 |
| 5,151,607 | A | 9/1992 | Crane et al. | 250/556 |
| 5,163,672 | A | 11/1992 | Mennie | 271/187 |
| 5,167,313 | A | 12/1992 | Dobbins et al. | 194/317 |
| 5,172,907 | A | 12/1992 | Kalisiak | 271/227 |
| 5,183,142 | A | 2/1993 | Latchinian et al. | 194/206 |
| 5,186,334 | A | 2/1993 | Fukudome et al. | 209/531 |
| 5,199,543 | A | 4/1993 | Kamagami et al. | 194/207 |
| 5,201,395 | A | 4/1993 | Takizawa et al. | 194/206 |
| 5,207,788 | A | 5/1993 | Geib | 271/122 |
| 5,220,395 | A | 6/1993 | Yamashita et al. | 355/313 |
| 5,232,216 | A | 8/1993 | Bybee | |
| 5,236,072 | A | 8/1993 | Cargill | 194/207 |
| 5,240,116 | A | 8/1993 | Stevens et al. | 209/534 |
| 5,261,518 | A | 11/1993 | Bryce | 194/207 |
| 5,295,196 | A | 3/1994 | Raterman et al. | 382/7 |
| 5,297,030 | A | 3/1994 | Vassigh et al. | 364/405 |
| 5,304,813 | A | 4/1994 | DeMan | 250/556 |
| 5,308,992 | A | 5/1994 | Crane et al. | 250/556 |
| 5,309,515 | A | 5/1994 | Troung et al. | 382/7 |
| 5,341,408 | A | 8/1994 | Melcher et al. | 377/8 |

| | | | | |
|---|---|---|---|---|
| 5,358,088 | A | 10/1994 | Barnes et al. | 194/206 |
| 5,363,949 | A | 11/1994 | Matsubayashi | 194/206 |
| 5,367,577 | A | 11/1994 | Gotaas | 382/135 |
| 5,394,992 | A | 3/1995 | Winkler | 209/552 |
| 5,397,003 | A | 3/1995 | Stevens et al. | 209/534 |
| 5,402,895 | A | 4/1995 | Mikkelsen et al. | |
| 5,408,417 | A | 4/1995 | Wilder | 364/479 |
| 5,418,458 | A | 5/1995 | Jeffers | 324/235 |
| 5,430,664 | A | 7/1995 | Cargill et al. | 364/550 |
| 5,437,357 | A | 8/1995 | Ota et al. | 385/135 |
| 5,445,277 | A | 8/1995 | Takemoto et al. | 209/534 |
| 5,465,821 | A | 11/1995 | Akioka | 194/207 |
| 5,467,405 | A | 11/1995 | Raterman et al. | 382/135 |
| 5,467,406 | A | 11/1995 | Graves et al. | 382/135 |
| 5,478,992 | A | 12/1995 | Hamada et al. | 235/379 |
| D369,984 | S | 5/1996 | Larsen | D10/97 |
| 5,553,320 | A | 9/1996 | Matsuura et al. | 235/379 |
| 5,607,040 | A | 3/1997 | Mathurin, Sr. | 194/207 |
| 5,616,915 | A | 4/1997 | Simpkins et al. | 250/221 |
| 5,633,949 | A | 5/1997 | Graves et al. | 382/135 |
| 5,639,081 | A | 6/1997 | Hatamachi et al. | 271/177 |
| 5,640,463 | A | 6/1997 | Csulits | 382/135 |
| 5,652,802 | A | 7/1997 | Graves et al. | 382/135 |
| 5,657,846 | A | 8/1997 | Schwartz | 194/206 |
| 5,680,472 | A | 10/1997 | Conant | 382/135 |
| 5,687,963 | A | 11/1997 | Mennie | 271/119 |
| 5,692,067 | A | 11/1997 | Raterman et al. | 382/135 |
| 5,704,491 | A | 1/1998 | Graves | 209/534 |
| 5,724,438 | A | 3/1998 | Graves | 382/135 |
| 5,751,840 | A | 5/1998 | Raterman et al. | 382/135 |
| 5,790,693 | A | 8/1998 | Graves et al. | 382/135 |
| 5,790,697 | A | 8/1998 | Jones et al. | 382/135 |
| 5,806,650 | A | 9/1998 | Mennie et al. | 194/206 |
| 5,815,592 | A | 9/1998 | Mennie et al. | 382/135 |
| 5,822,448 | A | 10/1998 | Graves et al. | 382/135 |
| 5,829,742 | A | 11/1998 | Rabindran et al. | |
| 5,832,104 | A | 11/1998 | Graves et al. | 382/135 |
| 5,867,589 | A | 2/1999 | Graves et al. | 382/135 |
| 5,870,487 | A | 2/1999 | Graves et al. | 382/135 |
| 5,875,259 | A | 2/1999 | Mennie et al. | 382/135 |
| 5,905,810 | A | 5/1999 | Jones et al. | 382/135 |
| 5,912,982 | A | 6/1999 | Munro et al. | 382/135 |
| 5,915,685 | A | 6/1999 | Bausch et al. | |
| 5,917,930 | A | 6/1999 | Kayani et al. | 382/135 |
| 5,938,044 | A | 8/1999 | Weggesser | 209/534 |
| 5,966,456 | A | 10/1999 | Jones et al. | 382/135 |
| 5,993,132 | A | 11/1999 | Harres et al. | |
| 6,012,565 | A | 1/2000 | Mazur | 194/207 |
| 6,021,883 | A | 2/2000 | Casanova et al. | 194/217 |
| 6,028,951 | A | 2/2000 | Raterman et al. | 382/135 |
| 6,074,334 | A | 6/2000 | Mennie et al. | |
| 6,439,395 | B1 * | 8/2002 | Voellmer et al. | 209/534 |

FOREIGN PATENT DOCUMENTS

| | | | |
|---|---|---|---|
| DE | 2935668 | C2 | 9/1979 |
| EP | 0077464 | A | 4/1983 |
| EP | 101115 | | 2/1984 |
| EP | 130824 | A2 | 6/1984 |
| EP | 130825 | A2 | 6/1984 |
| EP | 132329 | A2 | 6/1984 |
| EP | 206675 | B1 | 6/1986 |
| EP | 253935 | A2 | 10/1986 |
| EP | 264125 | A1 | 10/1987 |
| EP | 325364 | | 7/1989 |
| EP | 0338123 | | 10/1989 |
| EP | 0342647 | A2 | 11/1989 |
| EP | 0342647 | A3 | 11/1989 |
| GB | 2061232 | A | 9/1980 |
| GB | 2119138 | | 2/1983 |
| GB | 2190996 | A | 12/1987 |
| JP | 54-71673 | | 6/1979 |
| JP | 54-71674 | | 6/1979 |
| JP | 56-16287 | | 2/1981 |
| JP | 56-136689 | | 10/1981 |
| JP | 61-14557 | | 4/1986 |
| JP | 61-41439 | | 9/1986 |
| WO | WO 87/06041 | | 10/1987 |
| WO | WO 90/07165 | | 6/1990 |
| WO | WO 91/11778 | | 8/1991 |
| WO | WO 92/17394 | | 10/1992 |
| WO | WO 93/23824 | | 11/1993 |
| WO | WO 94/19773 | | 9/1994 |
| WO | WO 96/10800 | | 4/1996 |

OTHER PUBLICATIONS

U.S. patent application Ser. No. 09/688,526, Jenrick et al., filed Oct. 16, 2000.

Abstract of JP 60–52454.

Abstract of JP 2–302894.

Abstract of JP 3–98945.

Abstract of JP 3–111991.

Abstract of JP 4–275696.

Abstract of JP 05205436 (Publn. No. 07061417 A publ. Mar. 7, 1995).

Abstract of JP 07042545 (Publn. No. 08217269 A publ Aug. 27, 1996).

Abstract of JP 08298522 (Publn. No. 10143711 A publ May 29, 1998).

Abstract of JP 09071514 (Publn. No. 10269396 A publ Oct. 9, 1998).

AFB Currency Recognition System (1982).

Banking Machine Digest No. 31 (last page of C12 translation has a date of Dec. 5, 1988) (Japanese).

First Translation of Banking Machine Digest No. 31 (C11).

Second Translation of Banking Machine Digest No. 31 (C11) (Glory).

Third Translation of Banking Machine Digest No. 31 (C11).

Billcon D–202/204 Service Manual (cover marked 630229) (Japanese).

Translation of Billcon D–202/204 Service Manual—(C15).

Billcon D–202, D204 Operator's Manual (cover marked 611215) (Japanese).

First Translation of Billcon D–202, D204 Operator's Manual (C17).

Second Translation of Billcon D–202, D204 Operator's Manual (C17) (Glory).

Brochure "DeLa Rue Systems, The processing of money and documents;" date: copyr: 1987 (See e.g. 3120 Currency Sorting Machine, p. 3).

Brochure: "GFR–X Banknote Counter with Denomination Recognition", date: 12/94; pp. 3.

Brochure of Mosler Model CS 6600 Optical Currency Counter/Sorter, 4 pages, copyr. 1992.

Brochure by Toyocom, "New Currency Counter with Denomination Recognition, Toyocom NS" (Sep. 26, 1994) (1 page).

Chp. 7 of Mosler CF–420 Cash Management System, Operator's Manual©, 1989.

Cummins–Allison Corp. v. Glory U.S.A., Inc., N.D. Ill. 1998.

Currency Systems International, CPS 1200; 4 pages; date: copyr. 1992.

Currency Systems International/Currency Processing Systems, CPS 300; 4 pages; date: copyr. 1992.

Currency Systems International, Medium Speed Currency Sorting Family, CPS 600 and CPS 900; 4 pages; date: copyr. 1994.
Currency Systems International, Mr. W. Kranister in Conversation With Richard Haycock; pp. 1–5; dated: estimated 1994.
Declaration of Per Torling, 6 page (Mar. 18, 1999).
Description of Currency Systems International's CPS 600 and CPS 900 devices; date: estimated 1994.
Description of Toshiba–Mosler CF–420 Device; estimated 1989.
Drawings of portions of Mosler CF–420 Cash Management System (FIGs. A–C) and description of the same (1989).
Glory GFB–200/210/220/230, Desk–Top Bank Note Counter; 2 pages; date: estimated before Aug. 9, 1994.
Glory GFF–8CF and GFF–8 Desk–Top Currency and Check Counter; 4 pages; date: estimated Jan. 14, 1994.
Glory GFR–X Banknote Counter with Denomination Recognition; 3 pages; date: estimated Jan. 14, 1994.
Glory GFU–100 Desk–top Currency Fitness Sorter/Counter; 2 pages; date estimated Jan. 14, 1994.
Glory Instruction Manual for Model GFR–100 Currency Reader Counter, dated Aug. 15, 1995; pp. 26.
Glory UF–1D brochure; 2 pages; date: estimated before Aug. 9, 1994.
Glory GSA–500 Sortmaster brochure; 2 pages; dated Jan. 14, 1994.
Glory GSA–500 Sortmaster brochure; 4 pages; date: estimated Jan. 14, 1994.
JetScan Currency Scanner/Counter, Model 4060, Operator's Manual by Cummins–Allison (8/91).
JetScan Currency Scanner/Counter, Model 4061, Operating Instructions by Cummins–Allison (Apr. 20, 1993).
JetScan Currency Scanner/Counter, Model 4062, Operating Instructions by Cummins–Allison (Nov. 28, 1994).
Mosler CF–420 Cash Management System Operator's Manual, cover, copyright page, and chapter 5 pp. 5–1 through 5–16, copyrighted 1989.
Mosler Inc. Brochure "The Mosler/Toshiba CF–420", 1989.
Mosler–Toshiba Currency Sorter CF–400 Series; 4 pages; date: copyr. 1983.
News Product News by Toyocom, "Toyocom Currency Counter Now Reads Denominations", (Sep. 26, 1994) (1 page).
"Offer for Sale of Optical/Magnetic Detection 9/92".
"Sale of Doubles Detection 6/92".
"Sale of Doubles Detection 7/91".
Sale of JetScan Currency Scanner/Counter, Model 4060 (8/91).
Sale of JetScan Currency Scanner/Counter, Model 4061 (Arp. 20, 1993).
Sale of JetScan Currency Scanner/Counter, Model 4062 (Nov. 28, 1994).
"Sale of Magnetic Detection 7/91".
"Sale of Multiple Density Sensitivity Setting 4/93".
"Sale of Multiple Magnetic Sensitivity Setting 4/93".
Toshiba–Mosler Operator's Manual of CF–420 Cash Settlement System; pp. 1 to C–3; copyr. 1989 (See eg. pps. 3–10; 4–10; and 5–7).
Toyocom Currency Counter, Model NS–100, "Operation Guide (Preliminary)" (Jun. 13, 1995).
First Translation of JP 61–14557.
Second Translation of JP 61–14557 (Glory).
Translation of JP 54–71673.
Translation of JP 54–71674.
Translation of JP 61–41439.
First Translation of JP 56–136689.
Second Translation of JP 56–136689 (Glory).
Translation of JP 56–16287.
Billcon Brochure: Note Counter with Detection K–100 series.
CSI, Inc. Web Page: CashCat Desktop Sorter and Specifications.
CSI, Inc. Web Page: CPS 300–600 and Specifications.
CSI, Inc. Web Page: CPS 900 and Specifications.
CSI, Inc. Web Page: CPS 1200–1500–1800 and Specifications.
Mosler Brochure: TouchSort Currency Processing System—One Touch One Pass One Solution.
Toyocom Brochure: NC–50 Currency Counter.
Toyocom Brochure: NS–200 Currency Recognizer.
Glory UW–200 Multipurpose Compact Currency Sorter, 4 pages, © 1999.
Glory UW–100 Compact Currency Fitness Sorter, 2 pages, © 1999.
Glory GFRT–1 Currency Scanner, 12/94.
Glory GFR–100 Currency Reader Counter Instruction Manual, 32 pages Aug. 20, 1998.
Glory Brochure "Unstoppable" GFR–100 ReadMaster Currency Discriminator, 2 pages. 8/98.
Glory Brochure "Tank Currency Discriminators" GFR–100 & GFB–700, 2 pages, Aug. 6, 1998.
Glory Brochure "Tank Currency Discriminators" GFR–100 & GFR–S80, 2 pages, Dec. 7, 1999.

* cited by examiner

CURRENCY HANDLING SYSTEM HAVING MULTIPLE OUTPUT RECEPTACLES

CROSS-REFERENCE TO RELATED APPLICATIONS

The application is a continuation-in-part of U.S. patent application Ser. No. 09/502,666 entitled "Currency Handling System Having Multiple Output Receptacles," which was filed on Feb. 11, 2000 and is assigned to the assignee of the present application.

FIELD OF THE INVENTION

The present invention relates generally to the field of currency handling systems and, more particularly, to a multi-pocket currency handling system for discriminating, authenticating, and/or counting currency bills.

BACKGROUND OF THE INVENTION

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but, also, processed with more options in a less expensive manner. At the upper end of sophistication in this area of technology are machines that are capable of rapidly identifying, discriminating, and counting multiple currency denominations and then delivering the sorted currency bills into a multitude of output compartments. Many of these high end machines are extremely large and expensive such that they are commonly found only in large institutions. These machines are not readily available to businesses which have monetary and space budgets, but still have the need to process large volumes of currency. Other high end currency handling machines require their own climate controlled environment which may place even greater strains on businesses having monetary and space budgets.

Currency handling machines typically employ magnetic sensing or optical sensing for denominating and authenticating currency bills. The results of these processes determines to which output compartment a particular bill is delivered to in a currency handling device having multiple output receptacles. For example, ten dollar denominations may be delivered to one output compartment and twenty dollar denominations to another, while bills which fail the authentication test are delivered to a third output compartment. Unfortunately, many prior art devices only have one output compartment which can be appropriately called a reject pocket. Accordingly, in those cases, the reject pocket may have to accommodate those bills which fail a denomination test or authentication test. As a result, different types of "reject" bills are stacked upon one another in the same output compartment leaving the operator unknowing as to which of those bills failed which tests.

During the lifetime of prior art currency handling devices it is likely that individual key components of the devices, including components specific to the output receptacles, will degrade and eventually fail. The failure of an individual components specific to an output receptacle can render that output receptacle inoperable. The inoperability of one of the output receptacles of prior art currency handling devices can render the entire device inoperable regardless of whether the remaining output receptacles are otherwise properly functioning. Component failures resulting in the inoperability of the entire device can have a devastating effect on the cash handling operations of users of these devices. The inventors of the present invention have found that currency handling devices play a vital role in the overall operation of a cash vault, including cash vaults at bank or casinos. The inventors estimate that over 90% (ninety percent) of the cash handled within a cash vault is processed by a currency handling device. Therefore, the failure of a currency handling device can have a disastrous effect on the operation of a cash vault or other operations relying on the performance of the currency handling device.

SUMMARY OF THE INVENTION

A currency handling device for rapidly processing a plurality of currency bills comprises an input receptacle adapted to receive the currency bills to be processed, a plurality of output receptacles adapted to receive the bills after the bills have been processed, a transport mechanism adapted to transport the bills, one at a time, along a transport path from the input receptacle to the plurality of output receptacles, an evaluating unit that is adapted to determine information concerning the bills, and a controller. The evaluation unit includes at least one sensor positioned along the transport path between the input receptacle and the plurality of output receptacles. The controller is adapted to operate the currency handling device according to a mode of operation wherein the mode of operation designates the output receptacle to which each of the bills are transported based on the determined information concerning the bill. The controller is adapted to disable at least one of the plurality of output receptacles. The controller is adapted to cause the transport mechanism to direct bills directed to the disabled one of the plurality of output receptacles pursuant to the mode of operation to an alternative output receptacle.

The above summary of the present invention is not intended to represent each embodiment, or every aspect, of the present invention. Additional features and benefits of the present invention will become apparent from the detail description, figures, and claim set forth below.

BRIEF DESCRIPTION OF THE DRAWINGS

Other objects and advantages of the invention will become apparent upon reading the following detailed description in conjunction with the drawings in which.

DETAILED DESCRIPTION OF THE ILLUSTRATED EMBODIMENTS

Figure 1A:
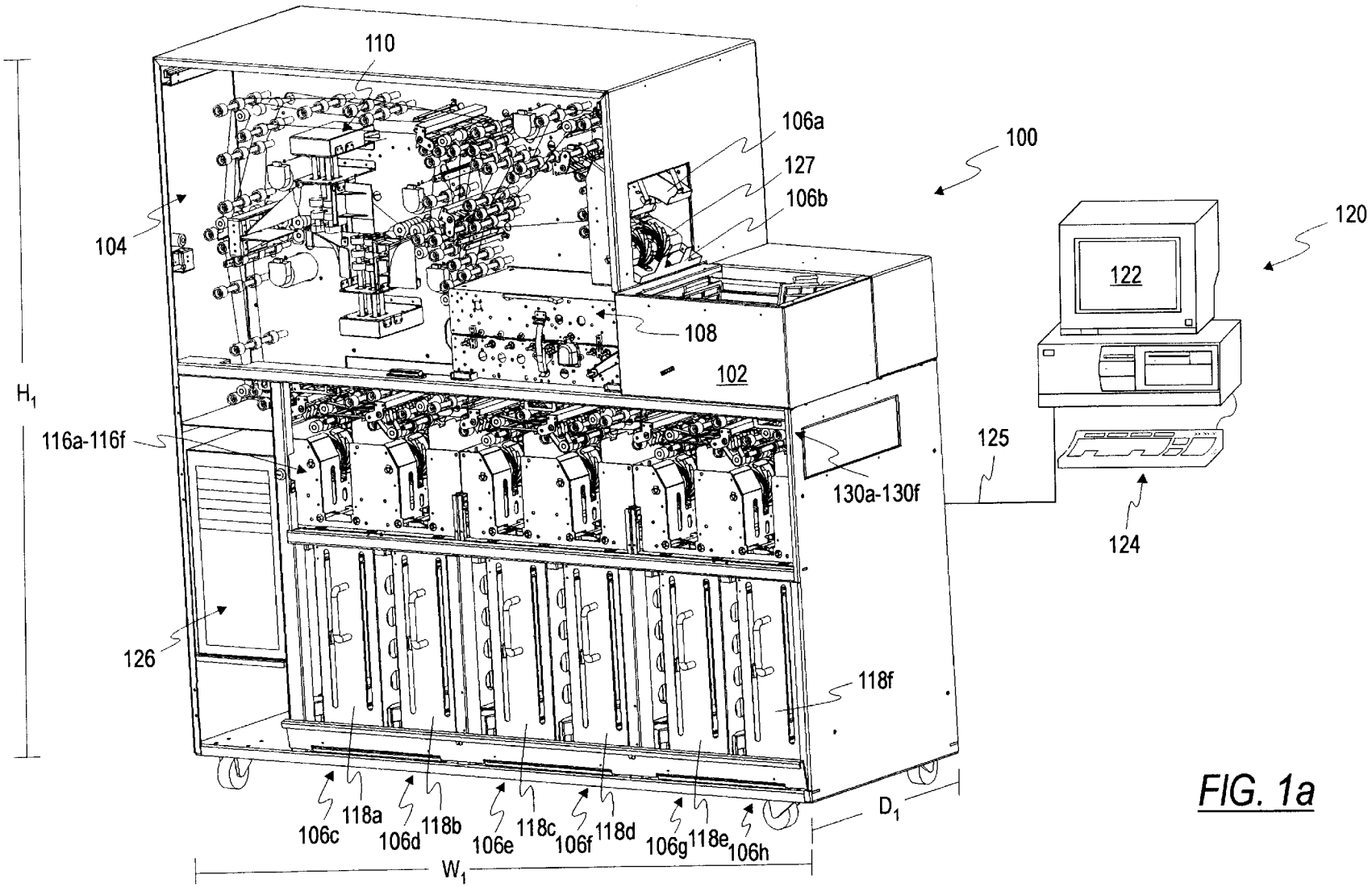
FIG. 1*a* is a perspective view of a document handling device according to one embodiment of the invention.
Figure 1B:
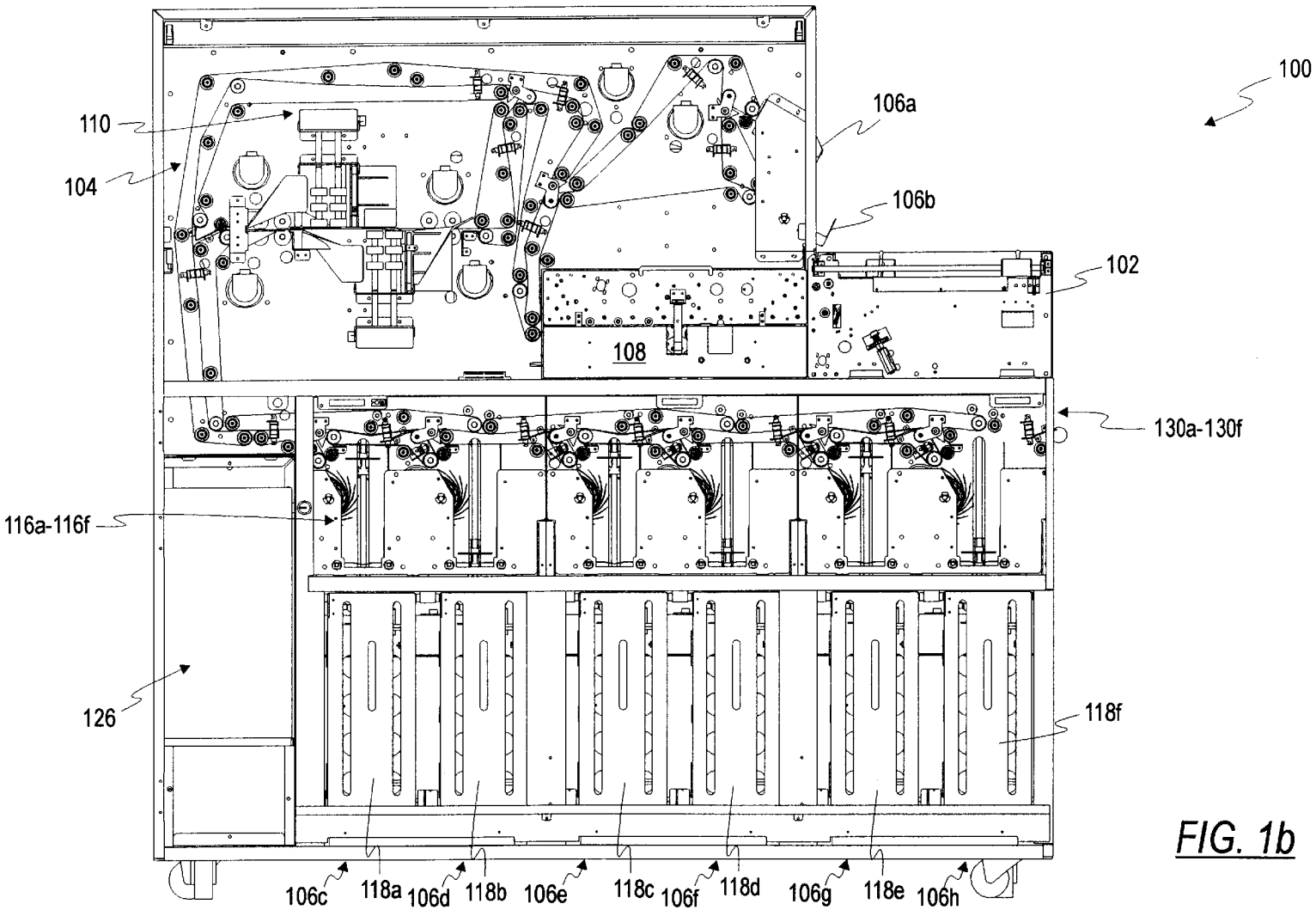
FIG. 1*b* is a front view of a document handling device according to one embodiment of the invention.

Referring to FIGS. 1*a* and 1*b*, a multi-pocket document processing device 100 such as a currency handling device according to one embodiment of the present invention is illustrated. Currency bills are fed, one by one, from a stack of currency bills placed in an input receptacle 102 into a transport mechanism 104. The transport mechanism 104 guides currency bills to one of a plurality of output receptacles 106*a*–106*h*, which may include upper output receptacles 106*a*, 106*b*, as well as lower output receptacles 106*c*–106*h*. Before reaching an output receptacle 106 the transport mechanism 104 guides the bill through an evaluation region 108 where a bill can be, for example, analyzed, authenticated, denominated, counted, and/or otherwise processed. In alternative embodiments of the currency handling device 100 of the present invention, the evaluation region 108 can determine bill orientation, bill size, or whether bills are stacked upon one another. The results of the above process or processes may be used to determine to which output receptacle 106 a bill is directed. The illustrated embodiment of the currency handling device has an overall width, $W_1$, of approximately 4.52 feet (1.38 meters), a height, $H_1$, of approximately 4.75 feet (1.45 meters), and a depth, $D_1$, of approximately 1.67 feet (0.50 meters).

In one embodiment, documents such as currency bills are transported, scanned, denominated, authenticated and/or otherwise processed at a rate equal to or greater than 600 bills per minute. In another embodiment, documents such as currency bills are transported, scanned, denominated, authenticated, and/or otherwise processed at a rate equal to or greater than 800 bills per minute. In another embodiment, documents such as currency bills are transported, scanned, denominated, authenticated and/or otherwise processed at a rate equal to or greater than 1000 bills per minute. In still another embodiment, documents such as currency bills are transported, scanned, denominated, authenticated, and/or otherwise processed at a rate equal to or greater than 1200 bills per minute.

In the illustrated embodiment, interposed in the bill transport mechanism 104, intermediate the bill evaluation region 108 and the lower output receptacles 106*c*–106*h* is a bill facing mechanism designated generally by reference numeral 110. The bill facing mechanism is capable of rotating a bill 180° so that the face position of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The leading edge of the bill remains constant while the bill is being rotated 180° by the facing mechanism 110. The decision may be taken to send a bill to the facing mechanism 110 when the selected mode of operation or other operator instructions call for maintaining a given face position of bills as they are processed by the currency handling device 100. For example, it may be desirable in certain circumstances for all of the bills ultimately delivered to the lower output receptacles 106*c*–106*h* to have the bill surface bearing the portrait of the president facing up. In such embodiments of the currency handling device 100, the bill evaluation region 108 is capable of determining the face position of a bill, such that a bill not having the desired face position can first be directed to the facing mechanism 110 before being delivered to the appropriate output receptacle 106. Further details of a facing mechanism which may be utilized for this purpose are disclosed in commonly-owned, U.S. Pat. No. 6,047,334, incorporated herein by reference in its entirety, which may be employed in conjunction with the present invention such as the device illustrated in FIGS. 1*a* and 1*b*. Alternatively, the facing mechanism disclosed in commonly-owned co-pending U.S. application Ser. No. 09/503,039, entitled "Two Belt Bill Facing Mechanism" which was filed on Feb. 11, 2000, incorporated herein by reference in its entirety, may be employed in conjunction with the present invention such as the device illustrated in FIGS. 1*a* and 1*b*. Other alternative embodiments of the currency handling device 100 do not include the facing mechanism 110.

The currency handling device 100 in FIG. 1*a* may be controlled from a separate controller or control unit 120 which has a display/user-interface 122, which may incorporate a touch panel display in one embodiment of the present invention, which displays information, including "functional" keys when appropriate. The display/user-interface 122 may be a full graphics display. Alternatively, additional physical keys or buttons, such as a keyboard 124, may be employed. The control unit 120 may be a self-contained desktop or laptop computer which communicates with the currency handling device 100 via a cable 125. The currency handling device 100 may have a suitable communications port (not shown) for this purpose. In embodiments in which the control unit 120 is a desktop computer wherein the display/user-interface 122 and the desktop computer are physically separable, the desktop computer may be stored within a compartment 126 of the currency handling device 100. In other alternative embodiments, the control unit 120 is integrated into the currency handling device 100 so the control unit 120 is contained within the device 100.

The operator can control the operation of the currency handling device 100 through the control unit 120. Through the control unit 120 the operator can direct the bills into specific output receptacles 106*a*–106*h* by selecting various user defined modes. In alternative embodiments, the user can select pre-programmed user defined modes or create new user defined modes based on the particular requirements of the application. For example, the operator may select a user defined mode which instructs the currency handling device 100 to sort bills by denomination, accordingly, the evaluation region 108 would denominate the bills and direct one dollar bills into the first lower output receptacle 106*c*, five dollar bills into the second lower output receptacle 106*d*, ten dollar bills into the third lower output receptacle 106*e*, twenty dollar bills into the forth lower output receptacle 106*f*, fifty dollar bills into the fifth lower output receptacle 106*g*, and one-hundred dollar bills into the sixth lower output receptacle 106*h*. The operator may also instruct the currency handling device 100 to deliver those bills whose denomination was not determined, no call bills, to the first upper output receptacle 106*a*. In such an embodiment, upper output receptacle 106*a* would function as a reject pocket. In an alternative embodiment, the operator may instruct the currency handling device 100 to also evaluate the authenticity of each bill. In such an embodiment, authentic bills would be directed to the appropriate lower output receptacle 106*c*–106*h*. Those bills that were determined not to be authentic, suspect bills, would be delivered to the second upper output receptacle 106*b*. A multitude of user defined modes are disclosed by co-pending U.S. patent application Ser. No. 08/916,100 entitled "Multi-Pocket Currency Discriminator" which was filed on Aug. 21, 1997, incorporated herein by reference in its entirety, which may be employed in conjunction with the present invention such as the device illustrated in FIGS. 1*a* and 1*b*.

According to one embodiment, the currency handling device 100 is designed so that when the evaluation region 108 is unable to identify certain criteria regarding a bill, the unidentified note is flagged and "presented" in one of the output receptacles 106*a*–106*h*, that is, the transport mechanism 104 is stopped so that the unidentified bill is located at a predetermined position within one of the output receptacles 106*a*–106*h*, such as being the last bill transported to one of the output receptacles. Such criteria can include denominating information, authenticating information, information indicative of the bill's series, or other information the evaluation region 108 is attempting to obtain pursuant to a mode of operation. Which output receptacles 106*a*–106*h* the flagged bill is presented in may be determined by the user according to a selected mode of operation. For example, where the unidentified bill is the last bill transported to an output receptacle 106*a*–106*h*, it may be positioned within a stacker wheel or positioned at the top of the bills already within the output receptacle 106*a*–106*h*. While unidentified bills may be transported to any output receptacles 106*a*–106*h*, it may be more convenient for the operator to have unidentified bills transported to one of the upper output receptacles 106*a,b* where the operator is able to easily see and/or inspect the bill which has not been identified by the evaluation region 108. The operator may then either visually inspect the flagged bill while it is resting on the top of the stack, or alternatively, the operator may decide to remove the bill from the output receptacle 106 in order to examine the flagged bill more closely. In an alternative embodiment of the currency handling device 100, the device 100 may communicate to the user via the display/user-interface 122 in which one of the output receptacles 106*a*–106*h* a flagged bill is presented.

The currency handling device 100 may be designed to continue operation automatically when a flagged bill is removed from the upper output receptacle 106*a,b* or, according to one embodiment of the present invention, the device 100 may be designed to suspend operation and require input from the user via the control unit 120. Upon examination of a flagged bill by the operator, it may be found that the flagged bill is genuine even though it was not identified as so by the evaluation region 108 or the evaluation may have been unable to denominate the flagged bill. However, because the bill was not identified, the total value and/or denomination counters will not reflect its value. According to one embodiment, such an unidentified bill is removed from the output receptacles 106 and reprocessed or set aside. According to another embodiment, the flagged bills may accumulate in the upper output receptacles 106*a,b* until the batch of currency bills currently being processed is completed or the output receptacle 106*a,b* is full and then reprocessed or set aside.

According to another embodiment, when a bill is flagged, the transport mechanism may be stopped before the flagged bill is transported to one of the output receptacles. Such an embodiment is particularly suited for situations in which the operator need not examine the bill being flagged; for example, the currency handling device 100 is instructed to first process United States currency and then British currency pursuant to a selected mode of operation where the currency handling device 100 processes United States $1, $5, $10, $20, $50, and $100 currency bills into the lower output receptacles 106*c*–106*h*, respectively. Upon detection of the first British pound note, the currency handling device 100 may halt operation allowing the operator to empty the lower output receptacles 106*c*–106*h* and to make any spatial adjustments necessary to accommodate the British currency. A multitude of modes of operation are described in conjunction with bill flagging, presenting, and/or transport halting in commonly owned, co-pending U.S. patent application Ser. No. 08/916,100 entitled "Method and Apparatus for Document Processing" which was filed on May 28, 1997, incorporated herein by reference in its entirety above, which may be employed in conjunction with the present invention such as the device illustrated in FIGS. 1*a* and 1*b*.

In the illustrated embodiment, with regard to the upper output receptacles 106*a*, 106*b*, the second upper output receptacle 106*b* is provided with a stacker wheel 127 for accumulating a number of bills, while the first upper output receptacle 106*a* is not provided with such a stacker wheel. Thus, when pursuant to a preprogrammed mode of operation or an operator selected mode or other operator instructions, a bill is to be fed to the first upper output receptacle 106*a*, there may be a further instruction to momentarily suspend operation of the currency handling device 100 for the operator to inspect and remove the bill. On the other hand, it may be possible to allow a small number of bills to accumulate in the first upper output receptacle 106*a* prior to suspending operation. Similarly, the second upper output receptacle 106*b* may be utilized initially as an additional one of the lower output receptacles 106*c*–106*h*. However, there is no storage cassette associated with the second upper output receptacle 106*b*. Therefore, when the second upper output receptacle 106*b* is full, operation may be suspended to remove the bills at such time as yet further bills are directed to the second upper output receptacle 106*b* in accordance with the selected mode of operation or other operator instructions. In an alternative embodiment of the currency handling device 100 both the first and the second upper output receptacles 106*a*, 106*b* are equipped with a stacker wheel. In such an embodiment both the upper output receptacles 106*a,b* may also function as the lower output receptacle 106*c*–106*h* allowing a number of bills to be stacked therein.

Figure 2A:
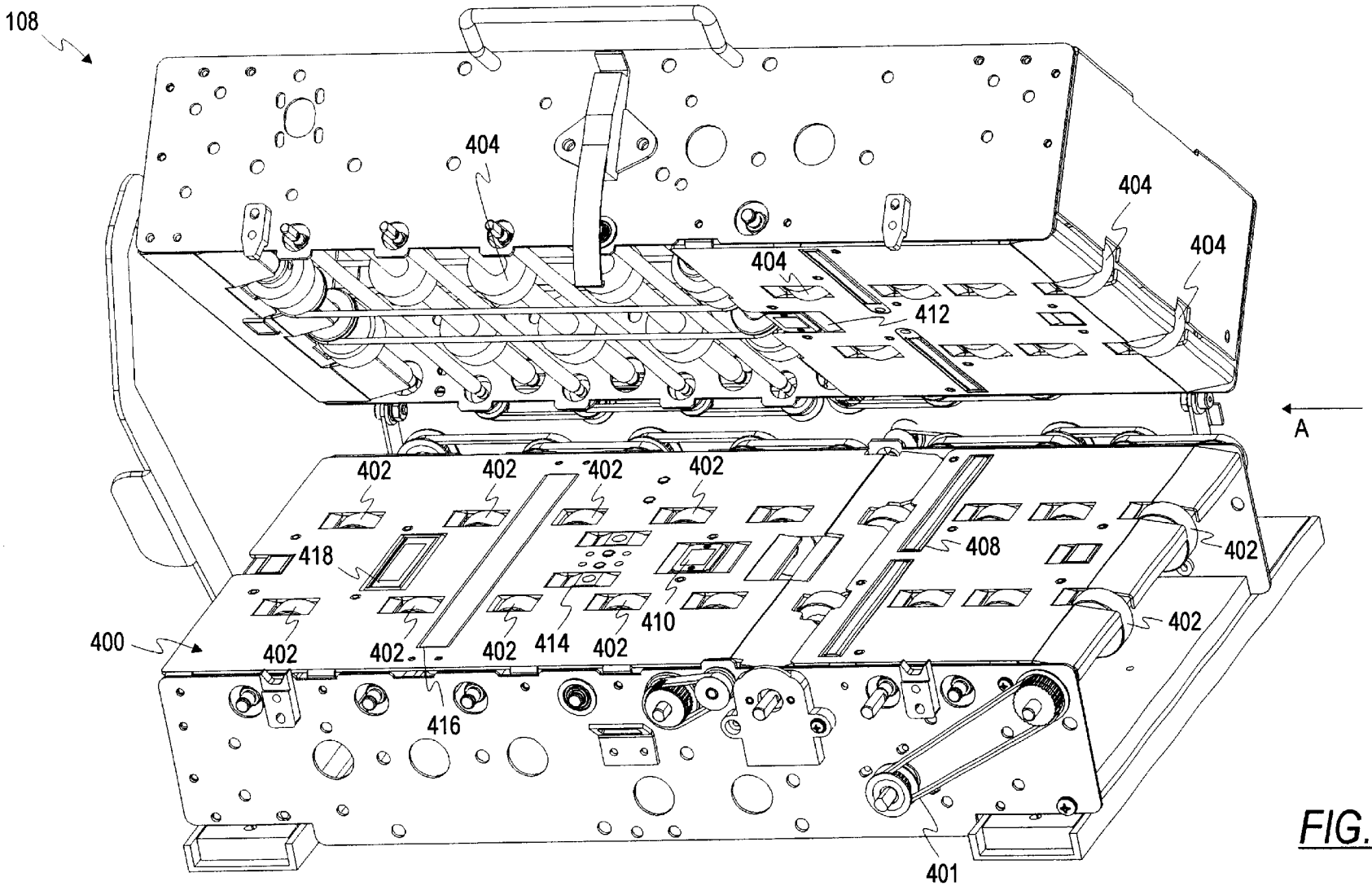
FIG. 2*a* is a perspective view of an evaluation region according to one embodiment of the document handling device of the present invention.
Figure 2B:
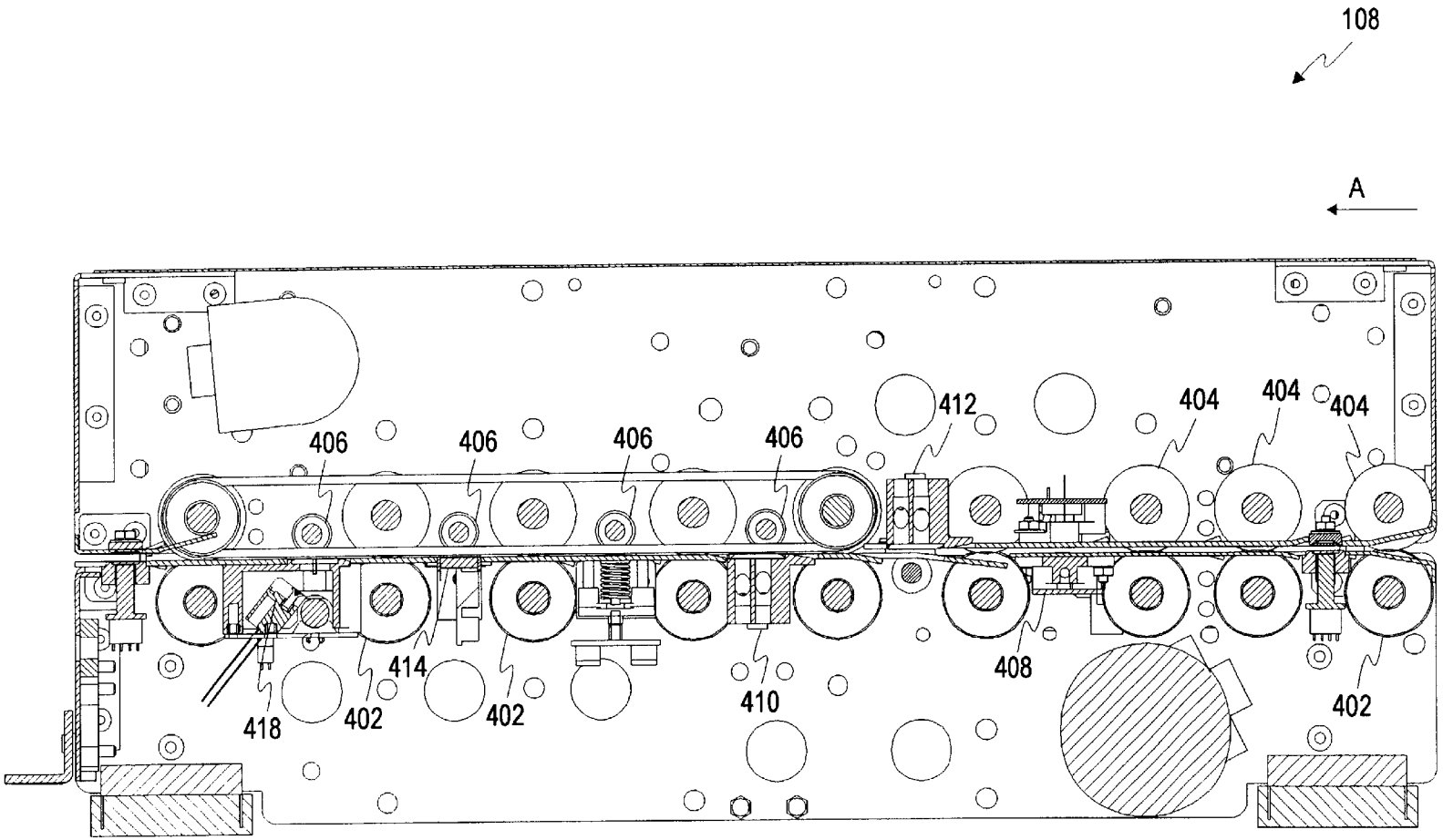
FIG. 2*b* is a side view of an evaluation region according to one embodiment of the document handling device of the present invention.

FIGS. 2*a* and 2*b* illustrate the evaluation region 108 according to one embodiment of the currency handling system 100. The evaluation region can be opened for service, access to sensors, clear bill jams, etc. as shown in FIG. 2*a*. The characteristics of the evaluation region 108 may vary according to the particular application and needs of the user. The evaluation region 108 can accommodate a number and variety of different types of sensors depending on a number of variables. These variables are related to whether the machine is authenticating, counting, or discriminating denominations and what distinguishing characteristics are being examined, e.g. size, thickness, color, magnetism, reflectivity, absorbabilty, transmissivity, electrical conductivity, etc. The evaluation region 108 may employ a variety of detection means including, but not limited to, a size detection and density sensor 408, a lower 410 and an upper 412 optical scan head, a single or multitude of magnetic sensors 414, a thread sensor 416, and an ultraviolet/fluorescent light scan head 418. These detection means and a host of others are disclosed in commonly owned, co-pending U.S. patent application Ser. No. 08/916,100 entitled "Multi-Pocket Currency Discriminator," incorporated by reference above.

The direction of bill travel through the evaluation region 108 is indicated by arrow A. The bills are positively driven along a transport plate 400 through the evaluation region 108 by means of a transport roll arrangement comprising both driven rollers 402 and passive rollers 404. The rollers 402 are driven by a motor (not shown) via a belt 401. Passive rollers 404 are mounted in such a manner as to be free-wheeling about their respective axis and biased into counter-rotating contact with the corresponding driven rollers 402. The driven and passive rollers 402, 404 are mounted so that they are substantially coplanar with the transport plate 400. The transport roll arrangement also includes compressible rollers 406 to aid in maintaining the bills flat against the transport plate 400. Maintaining the bill flat against the transport plate 400 so that the bill lies flat when transported past the sensors enhances the overall reliability of the evaluation processes. A similar transport arrangement is disclosed in commonly-owned U.S. Pat. No. 5,687,963 entitled "Method and Apparatus for Discriminating and Counting Documents," which is incorporated herein by reference in its entirety.

Referring now to FIGS. 3*a*–3*d*, the input receptacle 102 of the currency handling device 100 is illustrated. A feeder mechanism such as a pair of stripping wheels 140 aid in feeding the bills in seriatim to the transport mechanism 104 which first carries the bills through the evaluation region 108. According to one embodiment, the input receptacle 102 includes at least one spring-loaded feeder paddle 142*a* which is pivotally mounted, permitting it to be pivoted upward and drawn back to the rear of a stack of bills placed in the input receptacle 102 so as to bias the bills towards the evaluation region 108 via the pair of stripping wheels 140. The paddle 142*a* is coupled to an advance mechanism 144 to urge the paddle 142*a* towards the stripping wheels 140. In the illustrated embodiment, motion is imparted to the advance mechanism via a spring 145. In other alternative embodiments, the advance mechanism 144 is motor driven. The advance mechanism 144 is slidably mounted to a shaft 146. The advance mechanism 144 also constrains the paddle 142*a* to a linear path. The advance mechanism 144 may contain a liner bearing (not shown) allowing the paddle 142*a* to easily slide along the shaft 146. In the embodiment illustrated, the paddle 142*a* may also contain channels 148 to aid in constraining the paddle 142*a* to a linear path along a pair of tracks 150. The paddle 142*a* may additionally include a roller 152 to facilitate the movement of the paddle 142*a*.

Figure 3A:
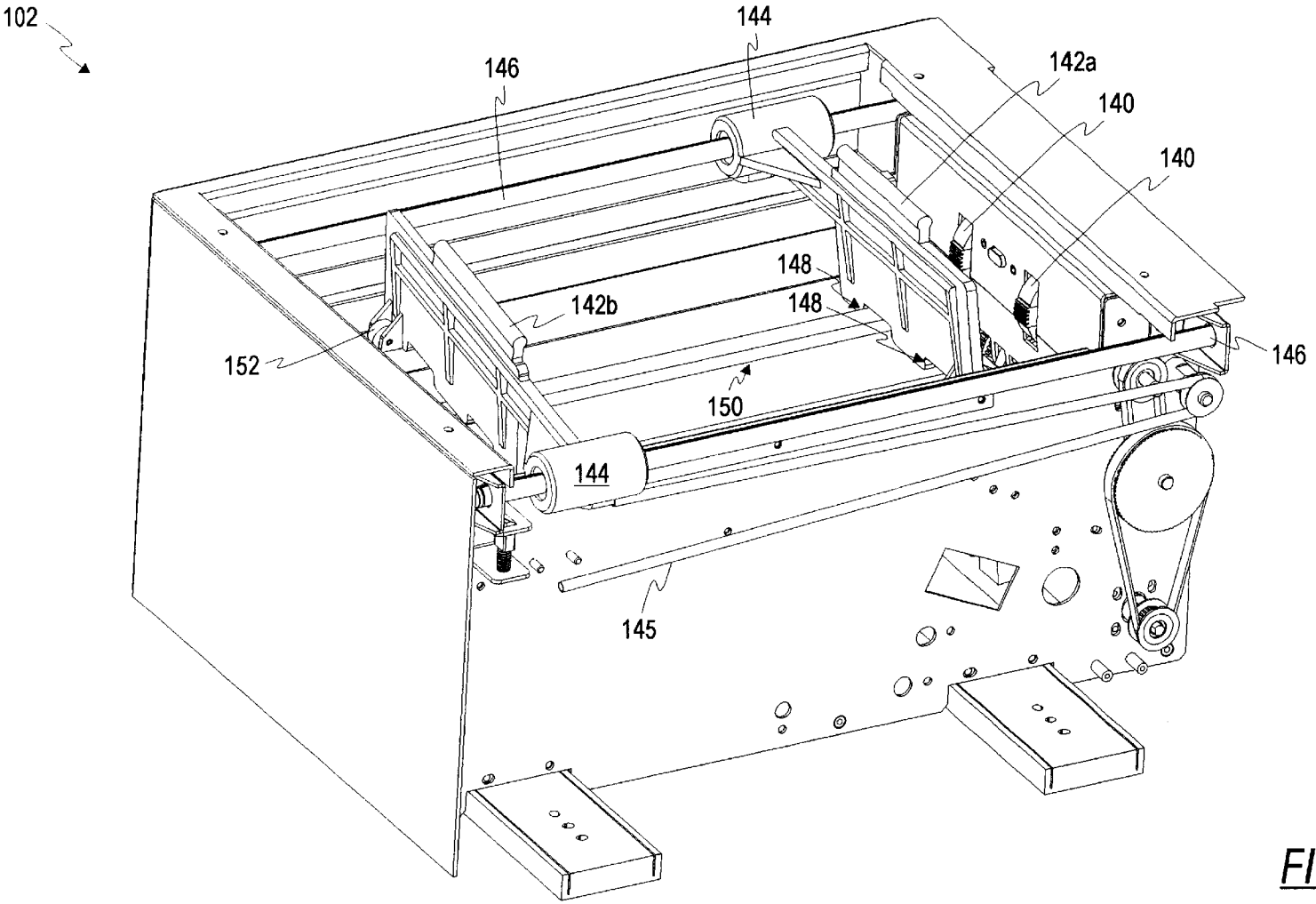
FIG. 3*a* is a perspective view of an input receptacle according to one embodiment of the document handling device of the present invention.
Figure 3B:
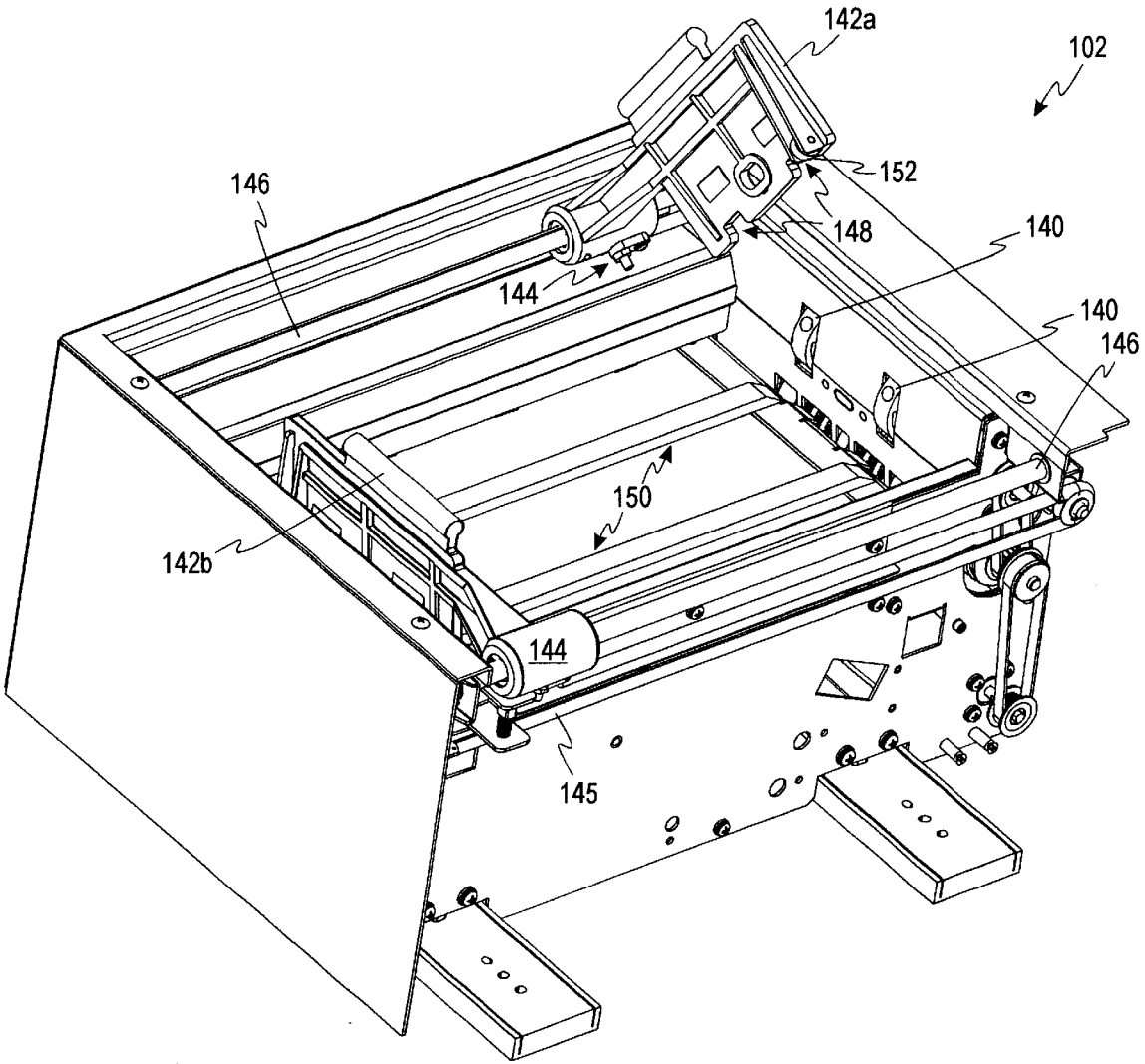
FIG. 3*b* is another perspective view of an input receptacle according to one embodiment of the document handling device of the present invention.
Figure 3C:
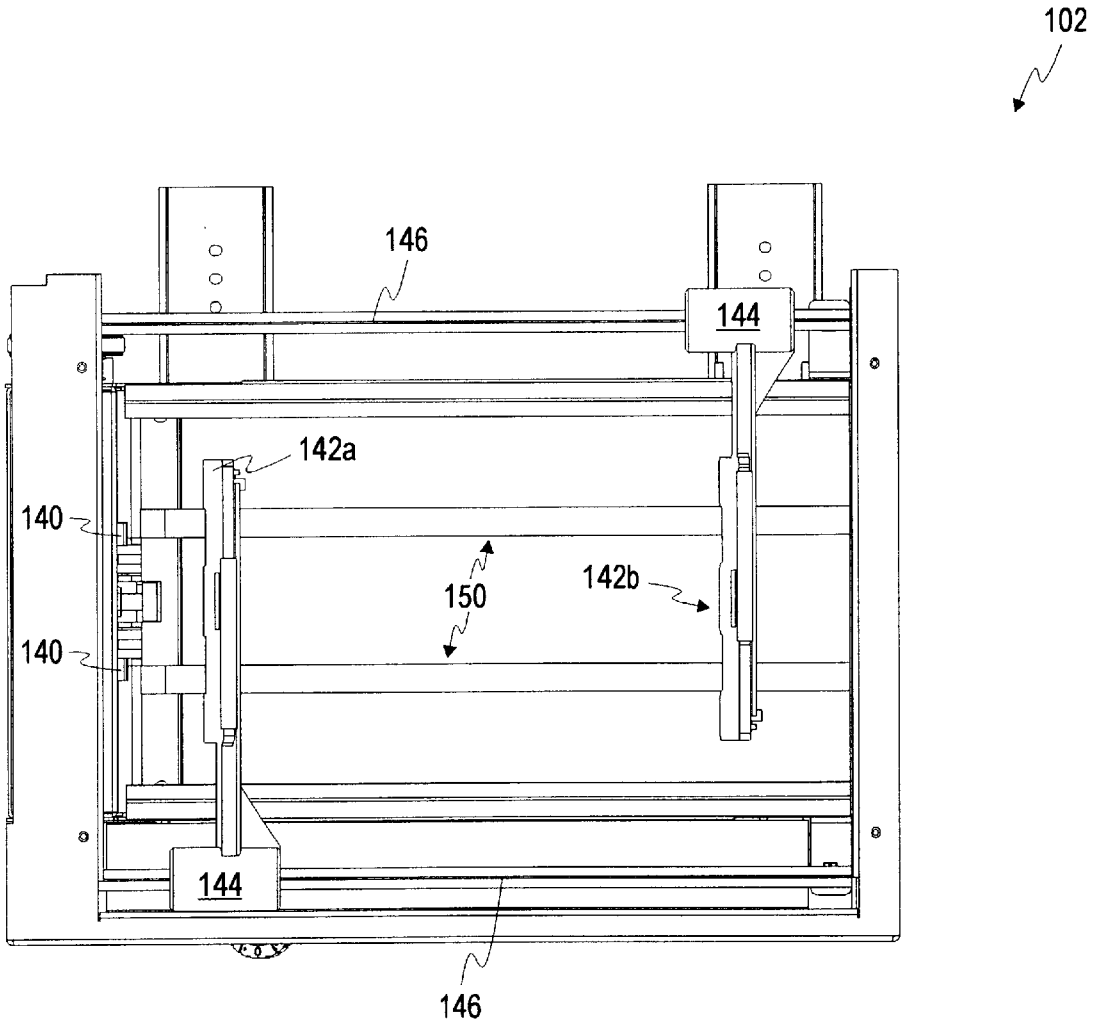
FIG. 3*c* is a top view of an input receptacle according to one embodiment of the document handling device of the present invention.
Figure 3D:
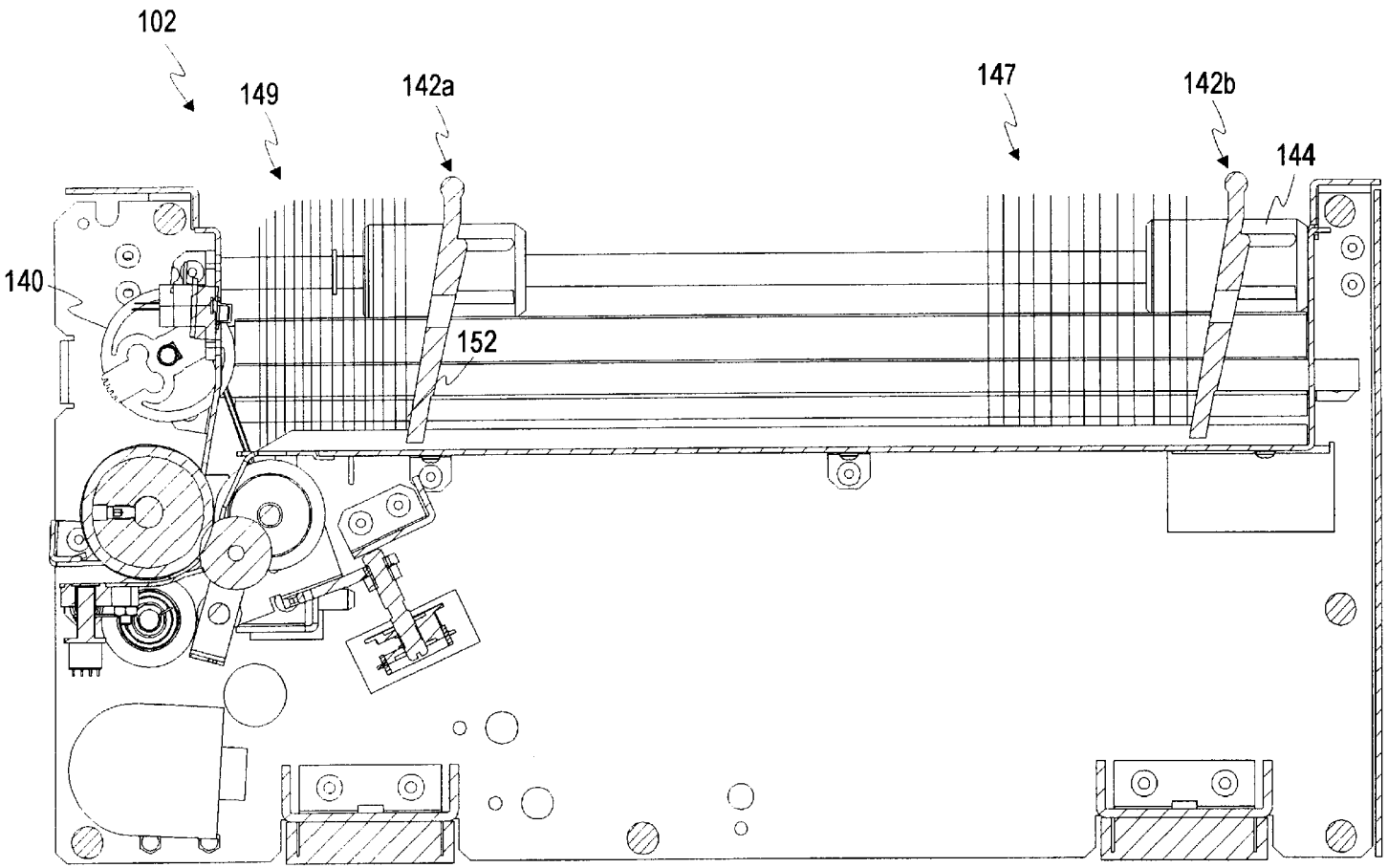
FIG. 3*d* is a side view of an input receptacle according to one embodiment of the document handling device of the present invention.

In the embodiment illustrated in FIGS. 3*d*–3*d*, a second paddle 142*b* is provided such that a second stack of bills 147 may be placed in the input receptacle 102 behind a first group of bills 149, while the first group of bills 149 is being fed into the currency handling device 100. Thus, the two feeder paddles 142*a* and 142*b* may be alternated during processing in order to permit multiple stacks of currency bills to be loaded into the input receptacle 102. In such an embodiment, the operator would retract paddle 142*a* and place a stack of bills into the input receptacle. Once inside the input receptacle, the operator would place the paddle 142*a* against the stack of bills so that the paddle 142*a* biases the stack of bills towards the pair of stripper wheels 140. The operator could then load a second stack of bills into the input receptacle 102 by retracting the second paddle 142*b* and placing a stack of bills in the input receptacle between the paddles 142*a* and 142*b*. The second paddle 142*b* urges the second stack of bills up against the backside of the first paddle 142*a*. The operator can then upwardly rotate the first paddle 142*a* thus combining the two stacks. The first paddle 142*a* is then retracted to the rear of the input receptacle and the process can be repeated. The two paddle input receptacle allows the operator to more easily continuously feed stacks of bills to the currency handling device 100. In devices not having two feeder paddles, the operator is forced to awkwardly manipulate the two stacks of bills and the advance mechanism. Alternatively, the operator may wait for the stack of bills to be processed out of the input receptacle to add another stack; however, waiting to reload until each stack is processed adds to the total time to process a given amount of currency.

Figure 4:
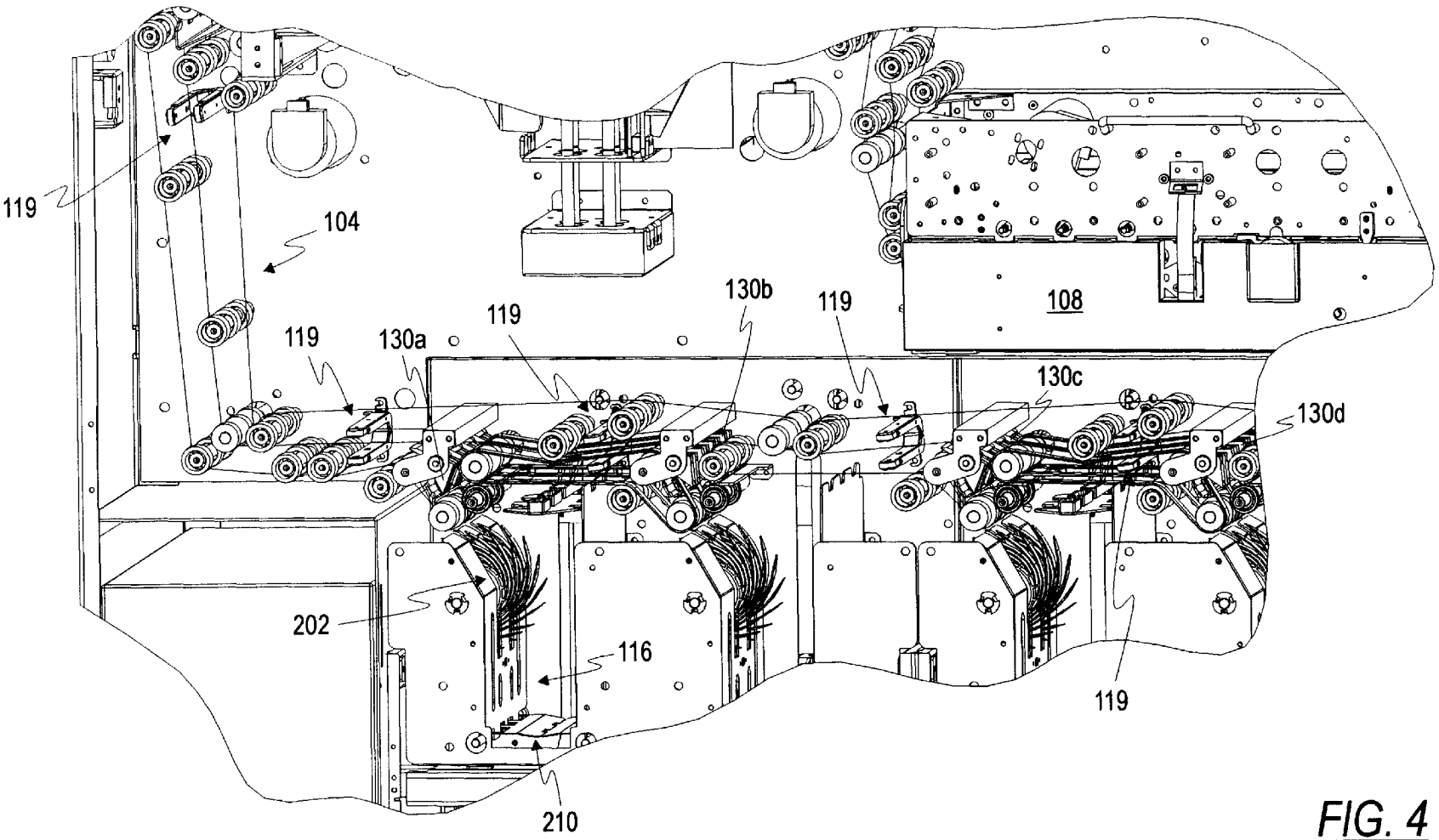
FIG. 4 is a perspective view of a portion of a transportation mechanism according to one embodiment of the present invention.

Referring to FIG. 4, a portion of the transport mechanism 104 and diverters 130*a*–130*d* are illustrated. A substantial portion of the transport path of the currency handling device 100 positively grips the bills during transport from the pair of stripping wheels 140 through the point where bills are delivered to upper output receptacle 106*a* or are delivered to the stacker wheels 202 of output receptacles 106*b*–106*h*. The positive grip transport path of the currency handling device 100 is less costly and weighs less than the vacuum transport arrangements of prior currency processing devices.

The transport mechanism 104 is electronically geared causing all sections to move synchronously from the evaluation region 108 through the point where the bills are delivered to the output receptacles 106. Multiple small motors are used to drive the transport mechanism 104. Using multiple small, less costly motors is more efficient and less costly than a single large motor. Further, less space is consumed enabling the currency handling device 100 to be more compact. Electronically gearing the transport mechanism 104 enables a single encoder to monitor bill transportation within the currency handling system 100. The encoder is linked to the bill transport mechanism 104 and provides input to a processor to determine the timing of the operations of the currency handling device 100. In this manner, the processor is able to monitor the precise location of the bills as they are transported through the currency handling device 100. This process is termed "flow control." Input from additional sensors 119 located along the transport mechanism 104 of the currency handling device 100 enables the processor to continually update the position of a bill within the device 100 to accommodate for bill slippage. When a bill leaves the evaluation region 108 the processor expects the bill to arrive at the diverter 130*a* corresponding to the first lower output receptacle 106*c* after a precise number of encoder counts. Specifically, the processor expects the bill to flow past each sensor 119 positioned along the transport mechanism 104 at a precise number of encoder counts. If the bill slips during transport but passes a sensor 119 later within an acceptable number of encoder counts the processor updates or "re-queues" the new bill position. The processor calculates a new figure for the time the bill is expected to pass the next sensor 119 and arrive at the first diverter 130*a*. The processor activates the one of the diverters 130*a*–*f* to direct the bill into the appropriate corresponding lower output receptacle 106*c*–106*h* when the sensor 119 immediately preceding the diverter 130 detects the passage of the bill to be directed into the appropriate lower output receptacle 106*c*–*h*.

The currency handling device 100 also uses flow control to detect jams within the transport mechanism 104 of the device 100. When a bill does not reach a sensor 119 within in the calculated number of encoder counts plus the maximum number of counts allowable for slippage, the processor suspends operation of the device 100 and informs the operator via the display/user-interface 122 that a jam has occurred. The processor also notifies the operator via the display/user-interface 122 of the location of the jam by indicating the last sensor 119 that the bill passed and generally the approximate location of the jam in the system. If the operator cannot easily remove the bill without damage, the operator can then electronically jog the transport path in the forward or reverse direction via the control unit 120 so that the jammed bill is dislodged and the operator can easily remove the bill from the transport path. The operator can then flush the system causing the transport mechanism 104 to deliver all of the bills currently within the transport path of the currency handling device 100 to one of the output receptacles 106. In an alternative embodiment, the user of the currency handling device 100 would have the option when flushing the system to first have the bills already within the escrow regions 116*a*–116*f* to be delivered to the respective lower storage cassettes 106*c*–106*h* so that those bills may be included in the aggregate value data for the bills being processed. The bills remaining in the transport path 104 would then be delivered to a predetermined escrow region 116 where those bills could be removed and reprocessed by placing those bills in the input receptacle 102.

Utilizing flow control to detect jams is more desirable than prior art currency evaluation machines which do not detect a jam until a sensor is actually physically blocked. The latter method of jam detection permits bills to pile up while waiting for a sensor to become blocked. Bill pile-up is problematic because it may physically halt the machine before the jam is detected and may cause physical damage to the bills and the machine. In order to remedy a jam in a prior art machine, the operator must first manually physically dislodge the jammed bills. The operator must then manually turn a hand crank which advances the transport path until all bills within the transport path are removed. Moreover, because the prior art devices permit multiple bills to pile up before a jam is detected, the integrity of the process is often ruined. In such a case, the entire stack of bills must be reprocessed.

Referring back to FIG. 1*a*, the illustrated embodiment of the currency handling device 100 includes a total of six lower output receptacles 106*c*–106*h*. More specifically, each of the lower output receptacles 106*c*–106*h* includes a first portion designated as an escrow compartment 116*a*–116*f* and a second portion designated as a storage cassette 118*a*–118*f*. Typically, bills are initially directed to the escrow compartments 116, and thereafter at specified times or upon the occurrence of specified events, which may be selected or programmed by an operator, bills are then fed to the storage cassettes 118. The storage cassettes are removable and replaceable, such that stacks of bills totaling a predetermined number of bills or a predetermined monetary value may be accumulated in a given storage cassette 118, whereupon the cassette may be removed and replaced with an empty storage cassette. In the illustrated embodiment, the number of lower output receptacles 106*c*–106*h* including escrow compartments 116 and storage cassettes 118 are six in number. In alternative embodiments, the currency handling device 100 may contain more or less than six lower output receptacles including escrow compartments and storage cassettes 118. In other alternative embodiments, modular lower output receptacles 106 can be implemented to add many more lower output receptacles to the currency handling system 100. Each modular unit may comprise two lower output receptacles. In other alternative embodiments, several modular units may be added at one time to the currency handling device 100.

A series of diverters 130*a*–130*f*, which are a part of the transportation mechanism 104, direct the bills to one of the lower output receptacles 106*c*–106*h*. When the diverters 130 are in an upper position, the bills are directed to the adjacent lower output receptacle 106. When the diverters 130 are in a lower position, the bills proceed in the direction of the next diverter 130.

Figure 5:
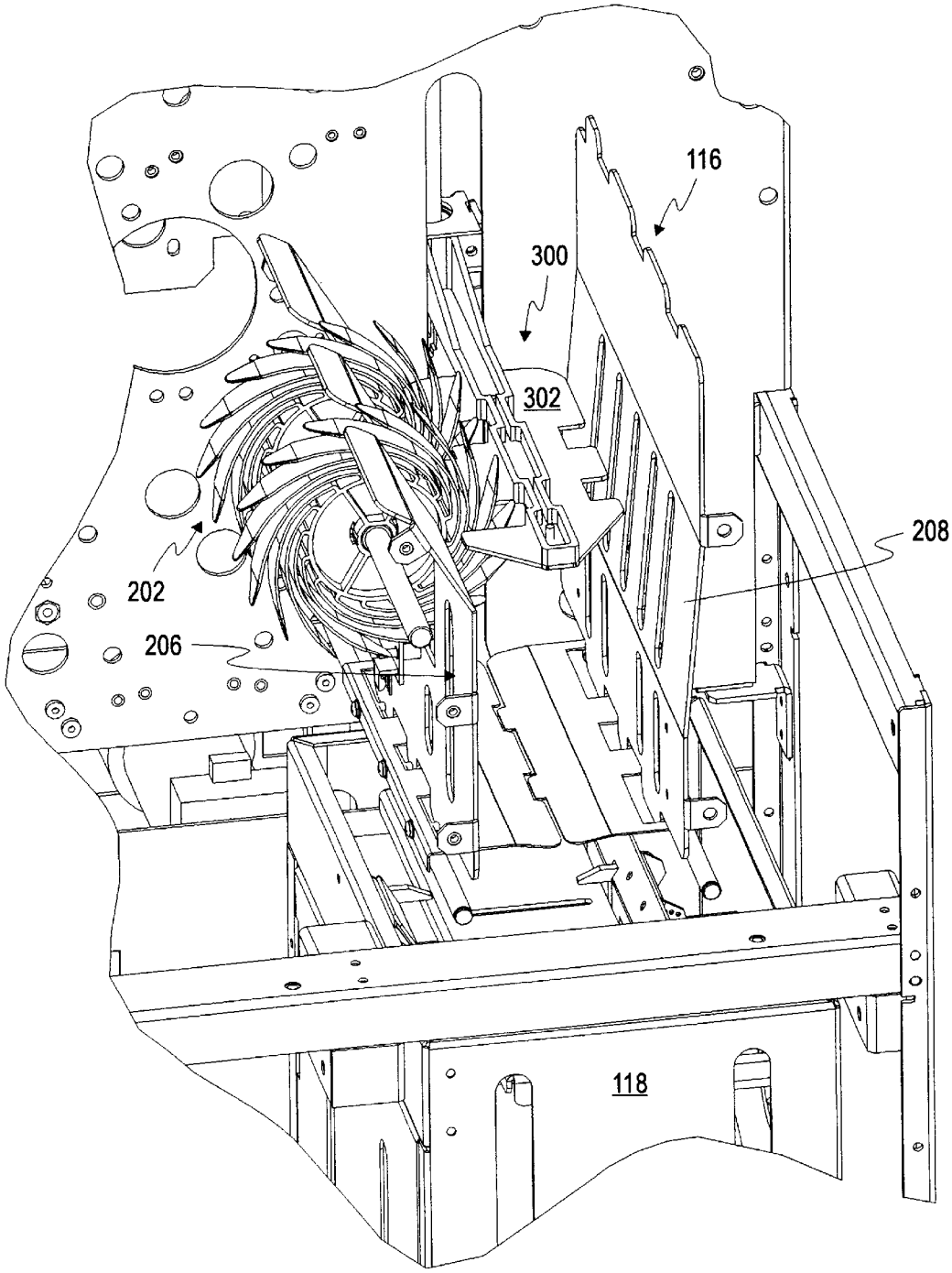
FIG. 5 is a front perspective view of an escrow compartment, a plunger assembly, and a storage cassette according to one embodiment of the document handling device of the present invention.

The vertical arrangement of the lower output receptacles 106*c*–106*h* is illustrated in FIG. 5. The escrow compartment 116 is positioned above the storage cassette 118. In addition to the escrow compartment 116 and the storage cassette 118, each of the lower output receptacles 106*c*–106*h* contains a plunger assembly 300. The plunger assembly 300 is shown during its decent towards the storage cassette 118.

Figure 6:
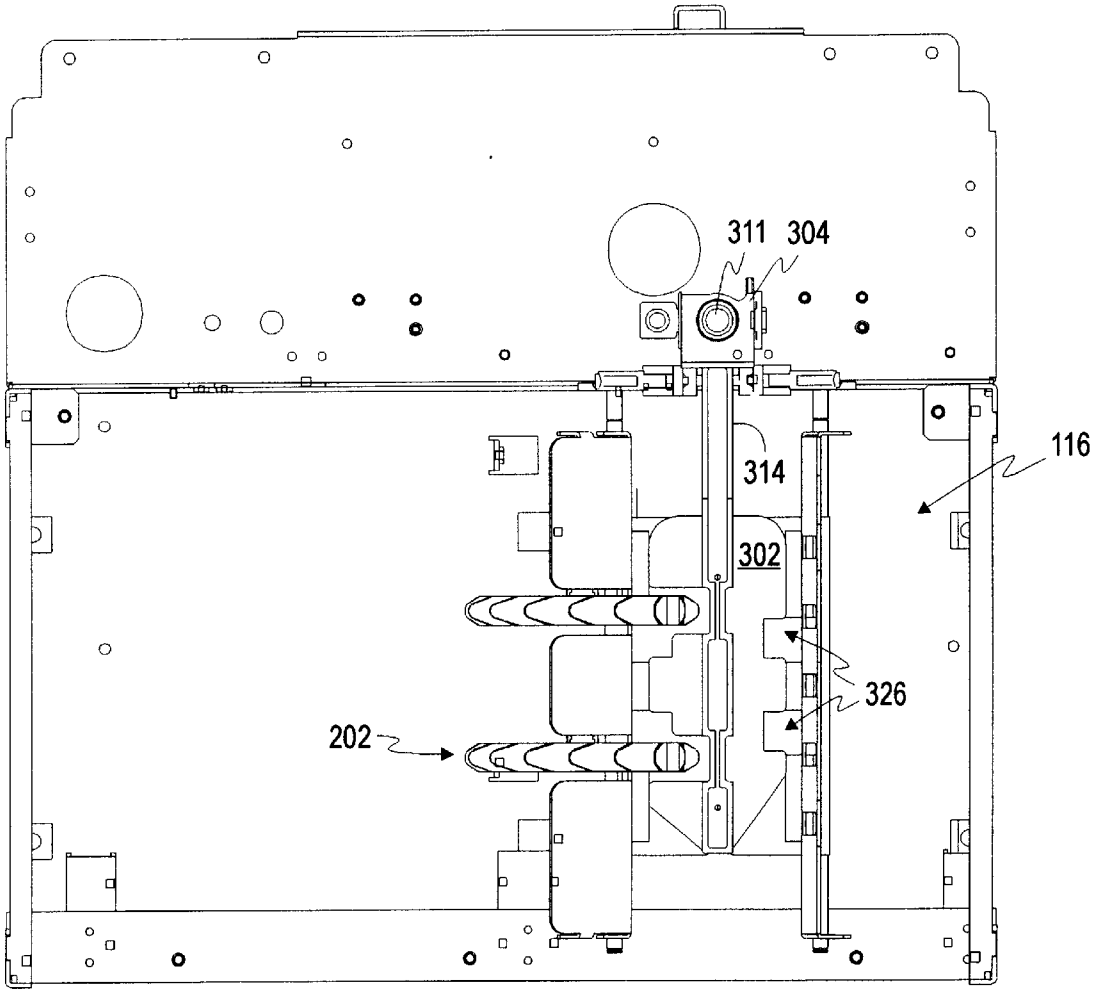
FIG. 6 is a top view of an escrow compartment and plunger assembly according to one embodiment of the document handling device of the present invention.
Figure 7:
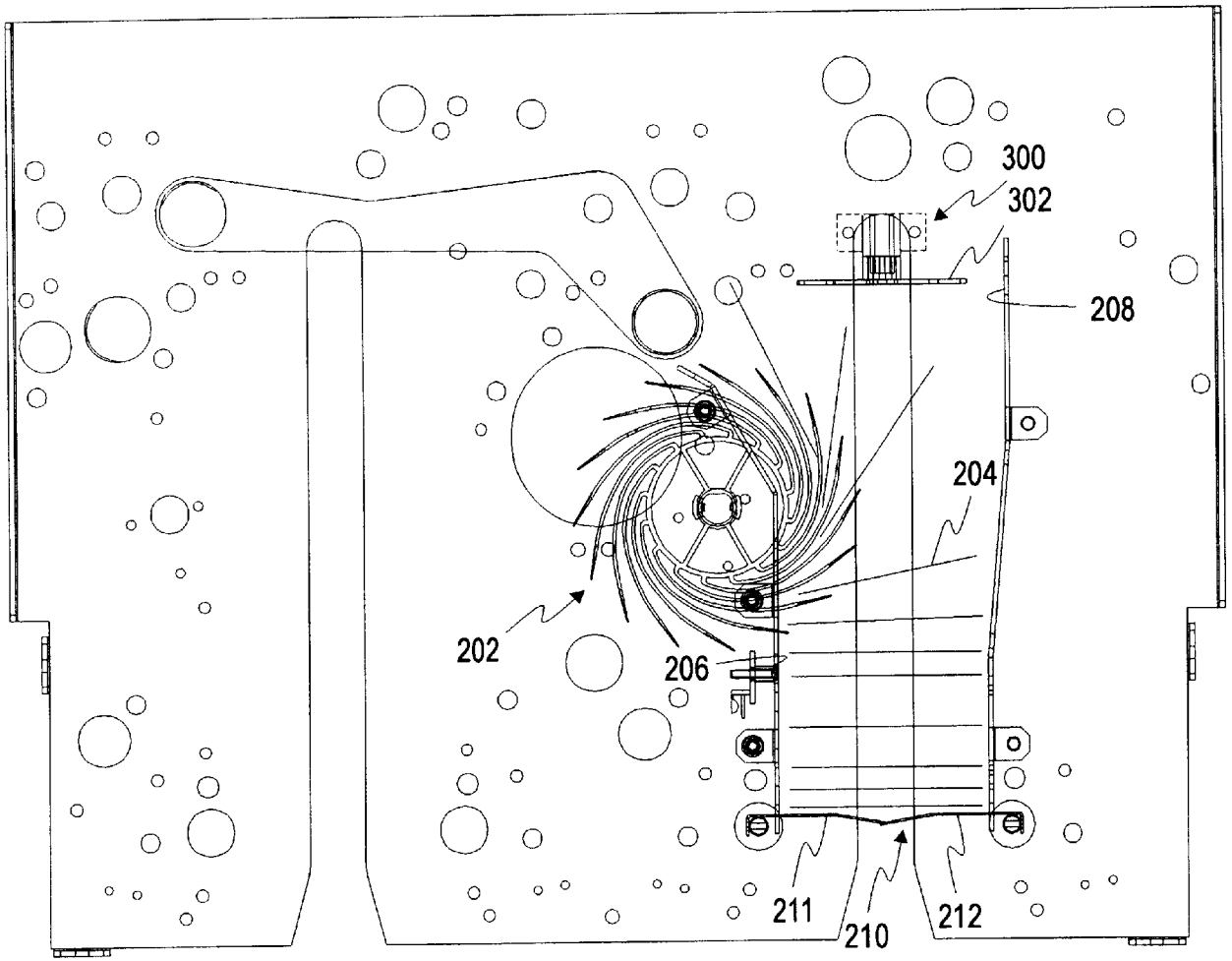
FIG. 7 is a front view of an escrow compartment and plunger assembly according to one embodiment of the document handling device of the present invention.

Referring now to FIGS. 6 and 7, one of the escrow compartments 116 of the lower output receptacles 106*c*–106*h* is shown. The escrow compartment 116 contains a stacker wheel 202 to receive the bills 204 from the diverter 130. The stacker wheel 202 stacks the bills 204 within the escrow compartment walls 206, 208 on top of a gate 210 disposed between the escrow compartment 116 and the storage cassette 118. In an alternative embodiment, the escrow compartment 116 contains a pair of guides to aid in aligning the bills substantially directly on top of one another. The gate 210 is made up of two shutters: a first shutter 211 and a second shutter 212. The shutters 211, 212 are hingedly connected enabling the shutters 211, 212 to rotate downward approximately ninety degrees to move the gate from a first position (closed position) wherein the shutters 211, 212 are substantially co-planer to a second position (open position) wherein the shutters 211, 212 are substantially parallel. Below the gate 210 is the storage cassette 118 (not shown in FIGS. 6 and 7).

Figure 8:
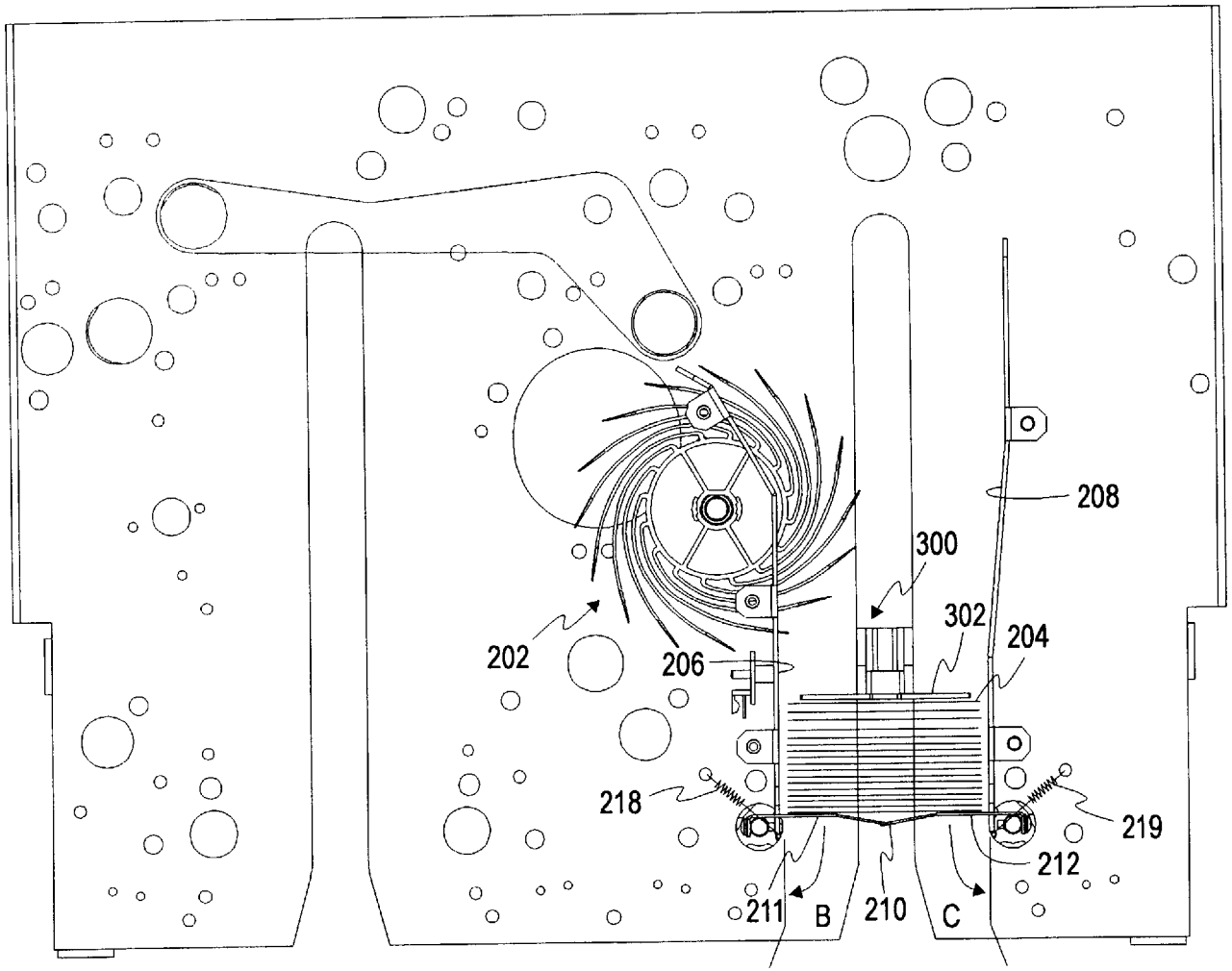
FIG. 8 is another front view of an escrow compartment and plunger assembly according to one embodiment of the document handling device of the present invention.

FIG. 8 illustrates the positioning of the paddle 302 when transferring a stack of bills from the escrow compartment 116 to the storage cassette 118. When the paddle descends upon the stack of bills 204 it causes shutters 211, 212 to quickly rotate in the directions referred to by arrows B and C, respectively; thus, "snapping" open the gate 210. The quick rotation of the shutters 211, 212 insures that the bills fall into the storage cassette 118 in a substantially stacked position. According to one embodiment, the paddle is programmed to descend after a predetermined number of bills 204 are stacked upon the gate 210. According to other embodiments, the operator can instruct the paddle 302 via the control unit 120 to descend upon the bills 204 stacked upon the gate 210.

Figure 9:
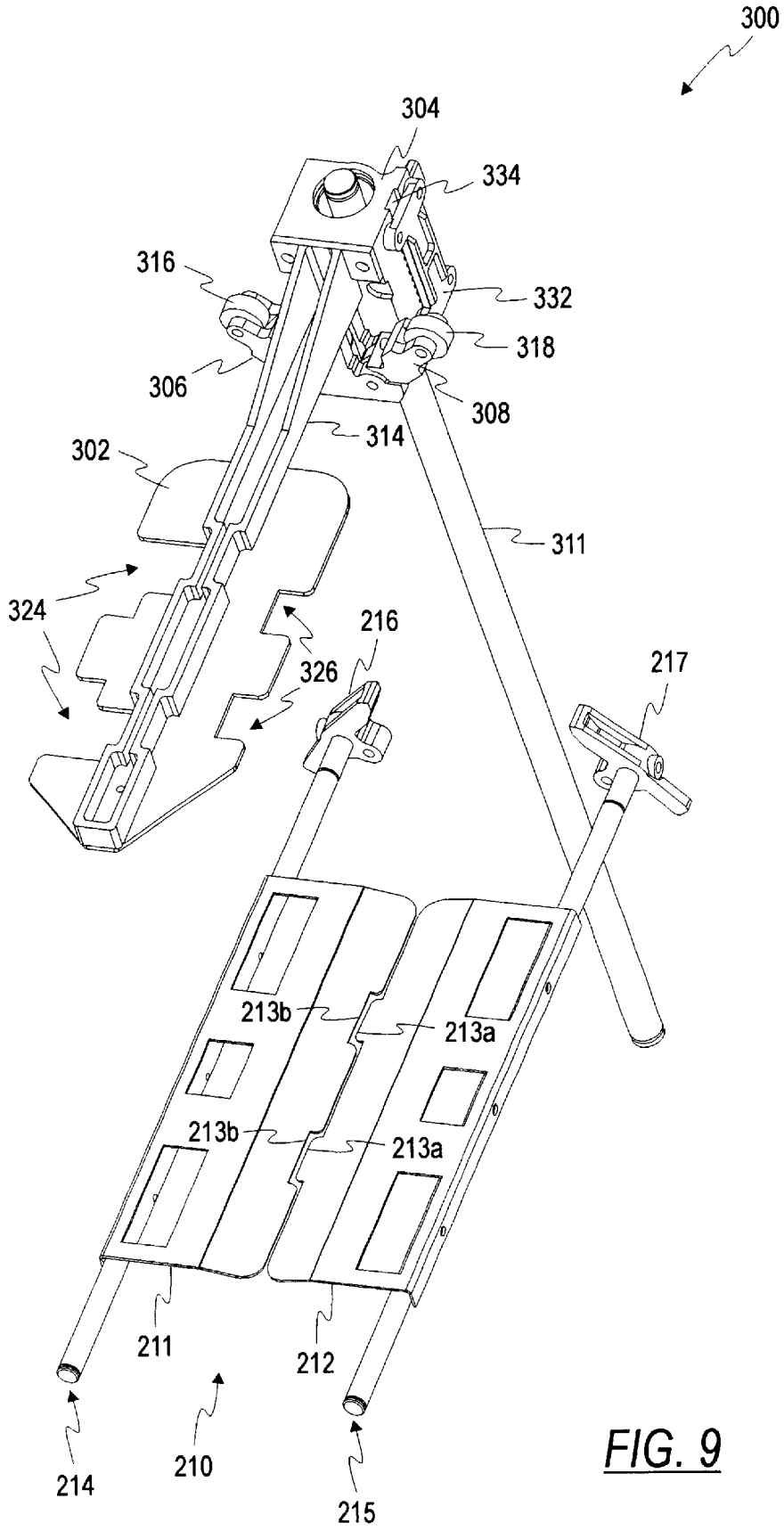
FIG. 9 is a perspective view of an apparatus for transferring currency from an escrow compartment to a storage cassette according to one embodiment of the document handling device of the present invention.

Referring now to FIG. 9, the plunger assembly 300 for selectively transferring the bills 204 from an escrow compartment 116 to a corresponding storage cassette 118 and the gate 210 are illustrated in more detail. One such plunger assembly 300 is provided for each of the six lower output receptacles 106*c*–106*h* of the currency handling device 100. The plunger assembly 300 comprises a paddle 302, a base 304, and two side arms 306, 308. Each of the shutters 211, 212 comprising the gate 210 extend inwardly from corresponding parallel bars 214, 215. The bars 214, 215 are mounted for pivoting the shutters between the closed position and the open position. Levers 216, 217 are coupled to the parallel bars 214, 215, respectively, to control the rotation of the bars 214, 215 and hence of the shutters 211, 212. Extension springs 218, 219 (shown in FIG. 8) tend to maintain the position of the levers 216, 217 both in the closed and open positions. The shutters 211, 212 have an integral tongue 213*a* and groove 213*b* arrangement which prevents any bills which are stacked upon the gate 210 from slipping between the shutters 211, 212.

The base 304 travels along a vertical shaft 311 with which it is slidably engaged. The base 304 may include linear bearings (not shown) to facilitate its movement along the vertical shaft 311. The plunger assembly 300 may also include a vertical guiding member 312 (see FIG. 11) with which the base 304 is also slidably engaged. The vertical guiding member 312 maintains the alignment of the plunger assembly 300 by preventing the plunger assembly 300 from twisting laterally about the vertical shaft 311 when the paddle 302 forces the bills 204 stacked in the escrow area 116 down into a storage cassette 118.

Figure 10:
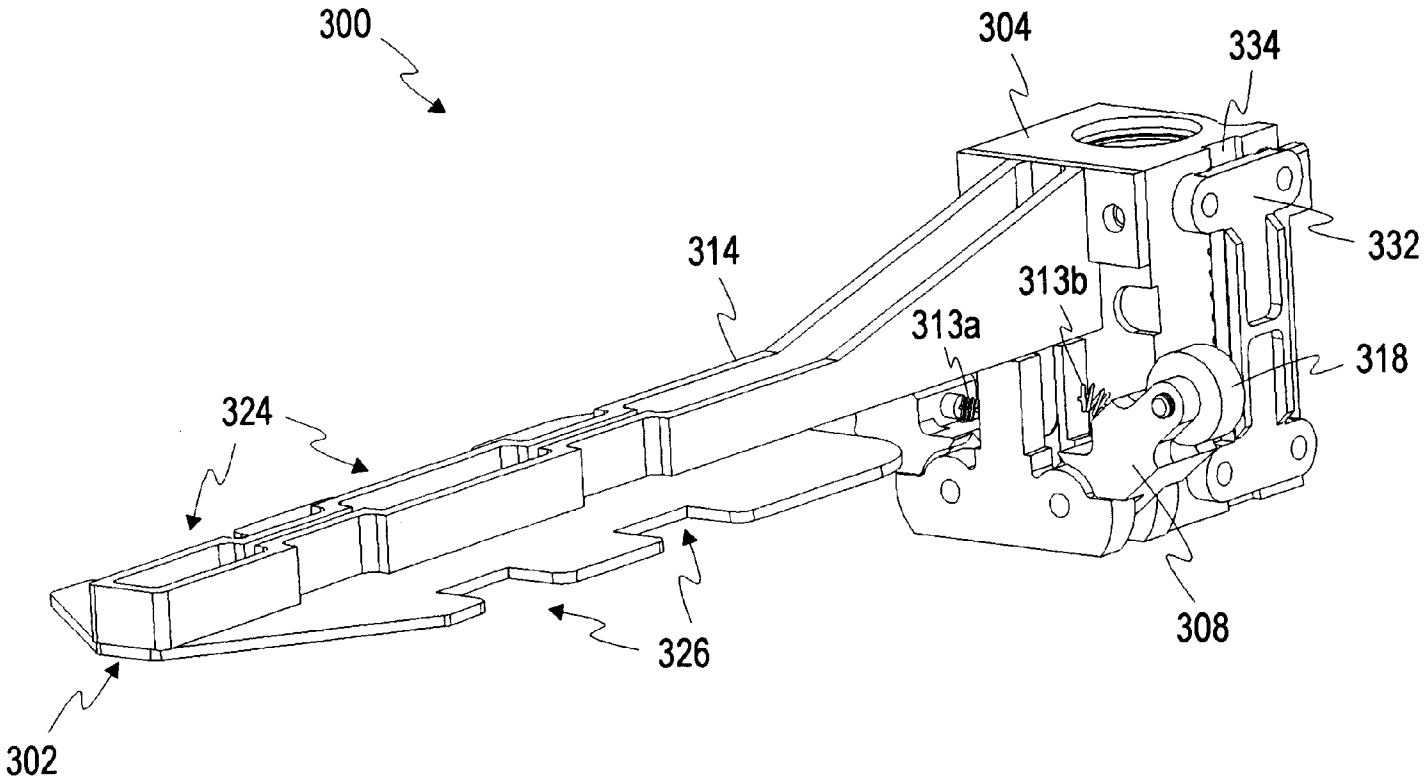
FIG. 10 is a perspective view of a paddle according to one embodiment of the document handling device of the present invention.

Referring also to FIG. 10, the paddle 302 extends laterally from the base 304. The paddle 302 is secured to a support 314 extending from the base 304. A pair of side arms 306, 308 are hingedly connected to the base. Each of the side arms 306, 308 protrude from the sides of the base 304. Rollers 316, 318 are attached to the side arms 306, 308, respectively, and are free rolling. Springs 313*a*, 313*b* are attached to the side arms 306, 308, respectively, to bias the side arms 306, 308 outward from the base 304. In the illustrated embodiment, the spring 313*a*, 313*b* are compression springs.

The paddle 302 contains a first pair of slots 324 to allow the paddle to clear the stacker wheel 202 when descending into and ascending out of the cassette 118. The first pair of slots 324 also enables the paddle 302 to clear the first pair of retaining tabs 350 within the storage cassette (see FIG. 14). Similarly, paddle 302 contains a second pair of slots 326 to enable the paddle 302 to clear the second pair of retaining tabs 350 within the storage cassette 118 (see FIG. 14).

Figure 11:
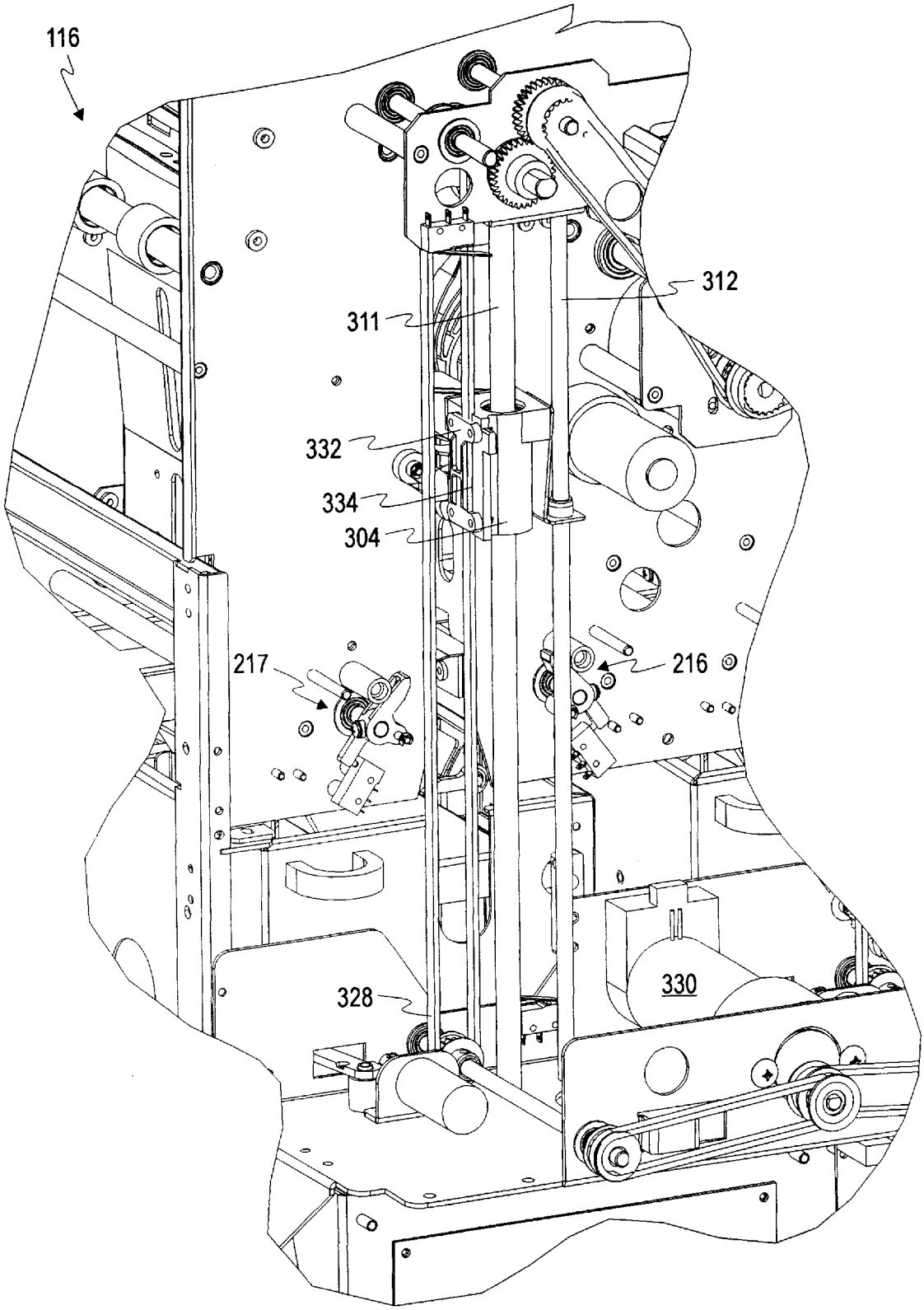
FIG. 11 is a rear perspective view of the escrow compartment, plunger assembly, and storage cassette according to one embodiment of the document handling device of the present invention.

Referring now to FIG. 11, which illustrates a rear view of one of the lower output receptacles 106*c*–106*h*, the plunger 300 is bidirectionally driven by way of a belt 328 coupled to an electric motor 330. A clamp 332 engages the belt 328 into a channel 334 in the base 304 of the plunger assembly 300. In the embodiment illustrated in FIG. 11, two plunger assemblies 300 are driven by a single electric motor 330. In one embodiment of the currency handling device, the belt 328 is a timing belt. In other alternative embodiments, each plunger assembly 300 can be driven by a single electric motor 330. In still other alternative embodiments, there can be any combination of motors 330 to plunger assemblies 300.

Figure 12:
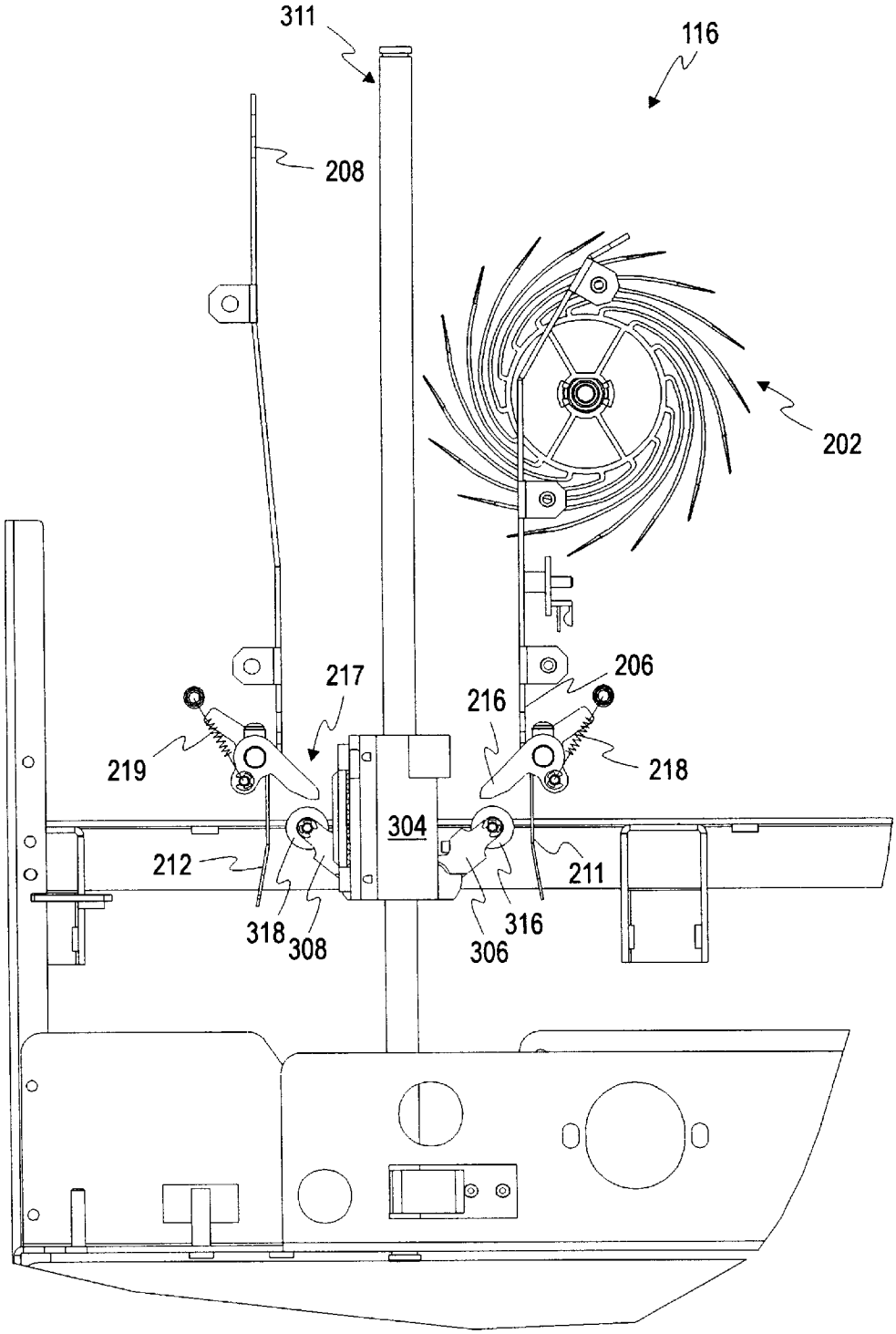
FIG. 12 is a rear view of a plunger assembly wherein the gate is in the open position according to one embodiment of the document handling device of the present invention.
Figure 13:
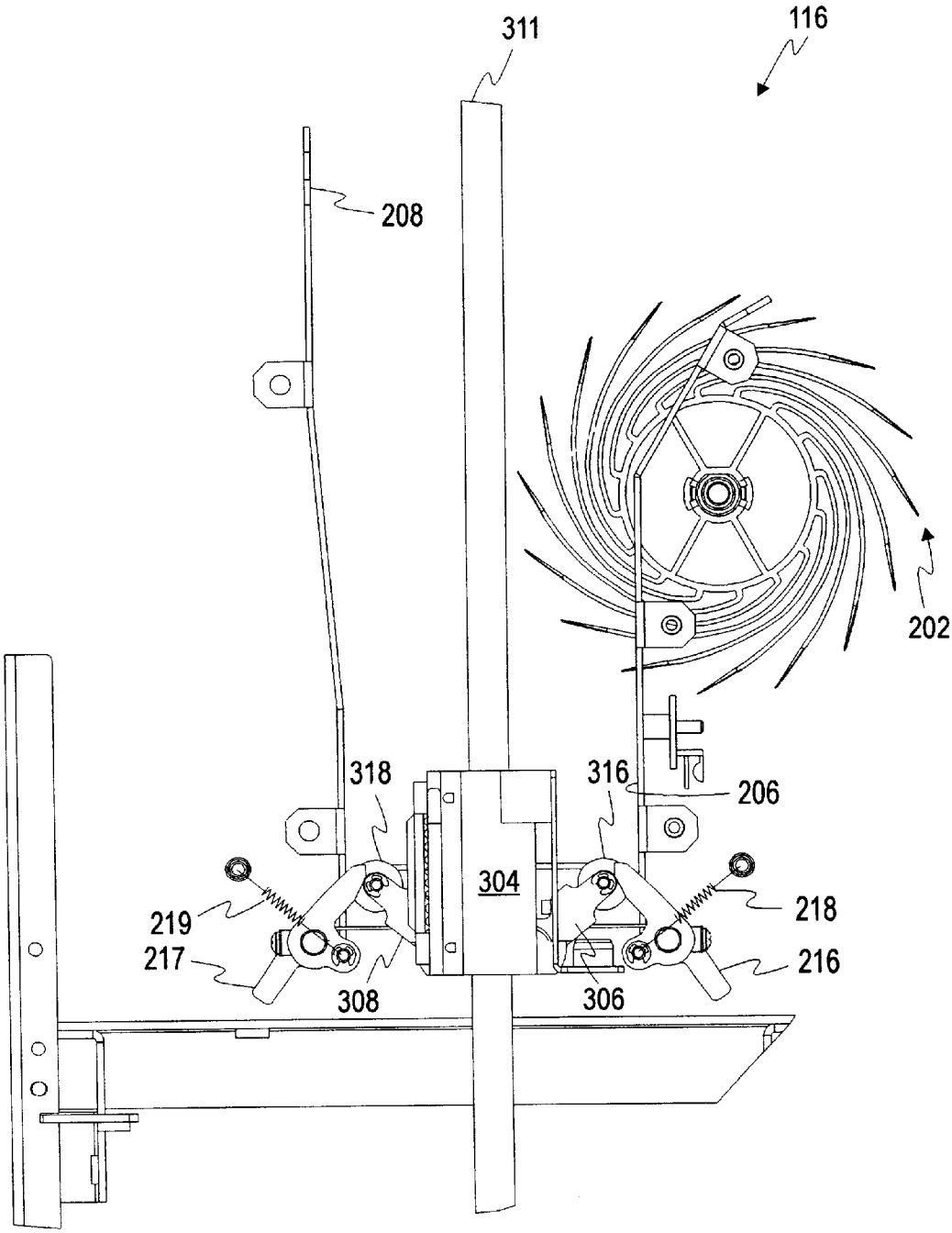
FIG. 13 is a rear view of a plunger assembly wherein the gate is in the closed position according to one embodiment of the document handling device of the present invention.

FIGS. 12 and 13 illustrate the interaction between the side arms 306, 308 and the levers 216, 217 when the paddle assembly 300 is descending towards and ascending away from the storage cassette 118, respectively. Initially, before descending towards the cassette, the shutters are in a first (closed) position. In the illustrated embodiment, it is the force imparted by the paddle 302 which opens the gate 210 when the paddle descends towards the storage cassette 118. When the paddle is ascending away from the storage cassette 119, it is the rollers 316, 318 coupled to the side arms 306, 308 which engage the levers 216, 217 that close the gate 210. The levers 216, 217 shown in FIG. 12 are positioned in the open position. When descending towards the storage cassette 118, the rollers 316, 318 contact the levers 216, 217 and roll around the levers 216, 217 leaving the shutters in the open position. The side arms 306, 308 are hinged in a manner which allows the side arms 306, 308 to rotate inward towards the base 304 as the rollers 316, 318 engage the levers 216, 217. FIG. 13 illustrates the levers in the second position wherein the gate 210 is closed. When the paddle ascends out of the storage cassette, the side arms 306, 308 are biased away from the base 304. The rollers 316, 318 engage the levers 216, 217 causing the levers to rotate upward to the first position thus closing the gate.

Figure 14:
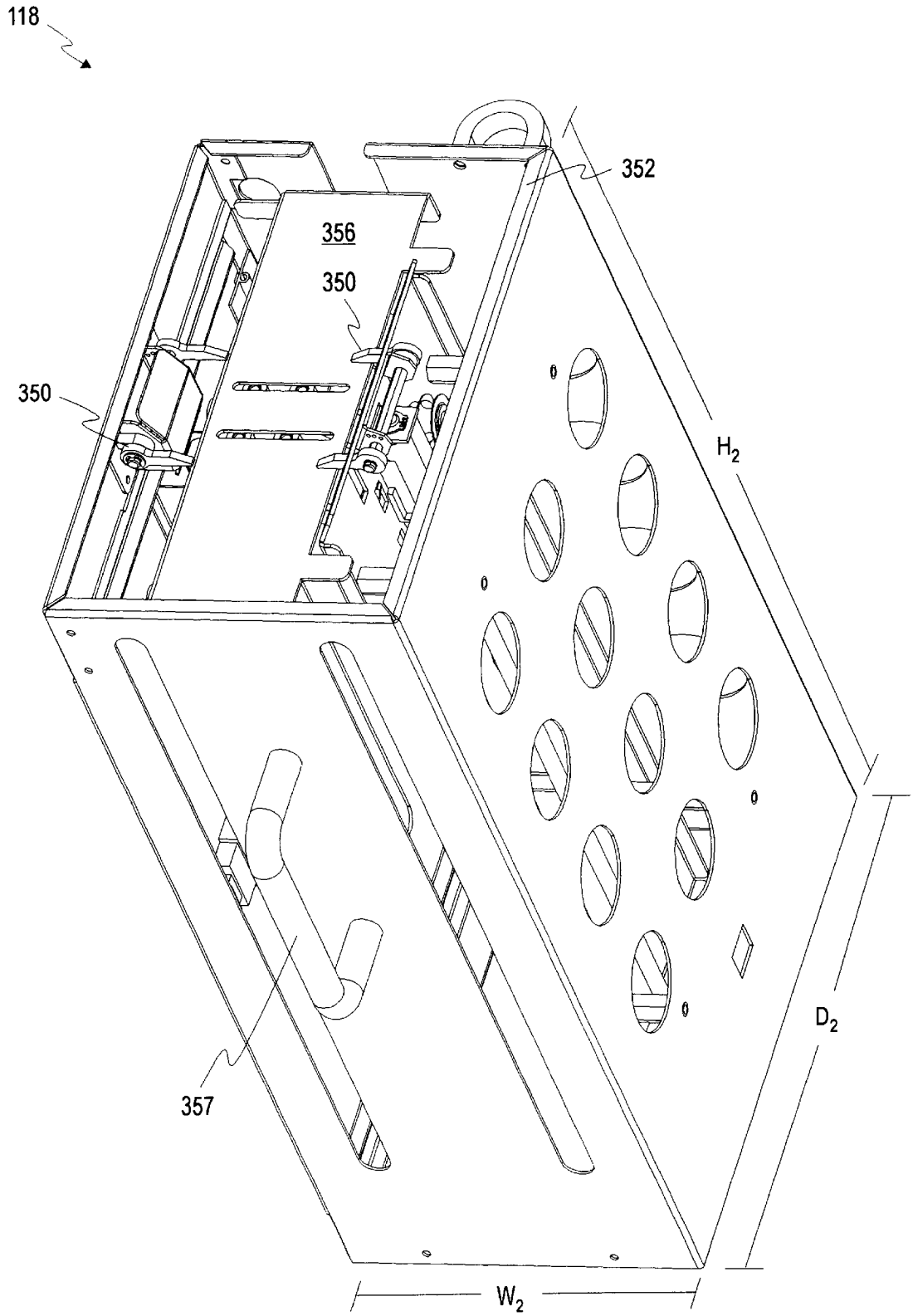
FIG. 14 is a perspective view of a storage cassette according to one embodiment of the document handling device of the present invention.
Figure 15:
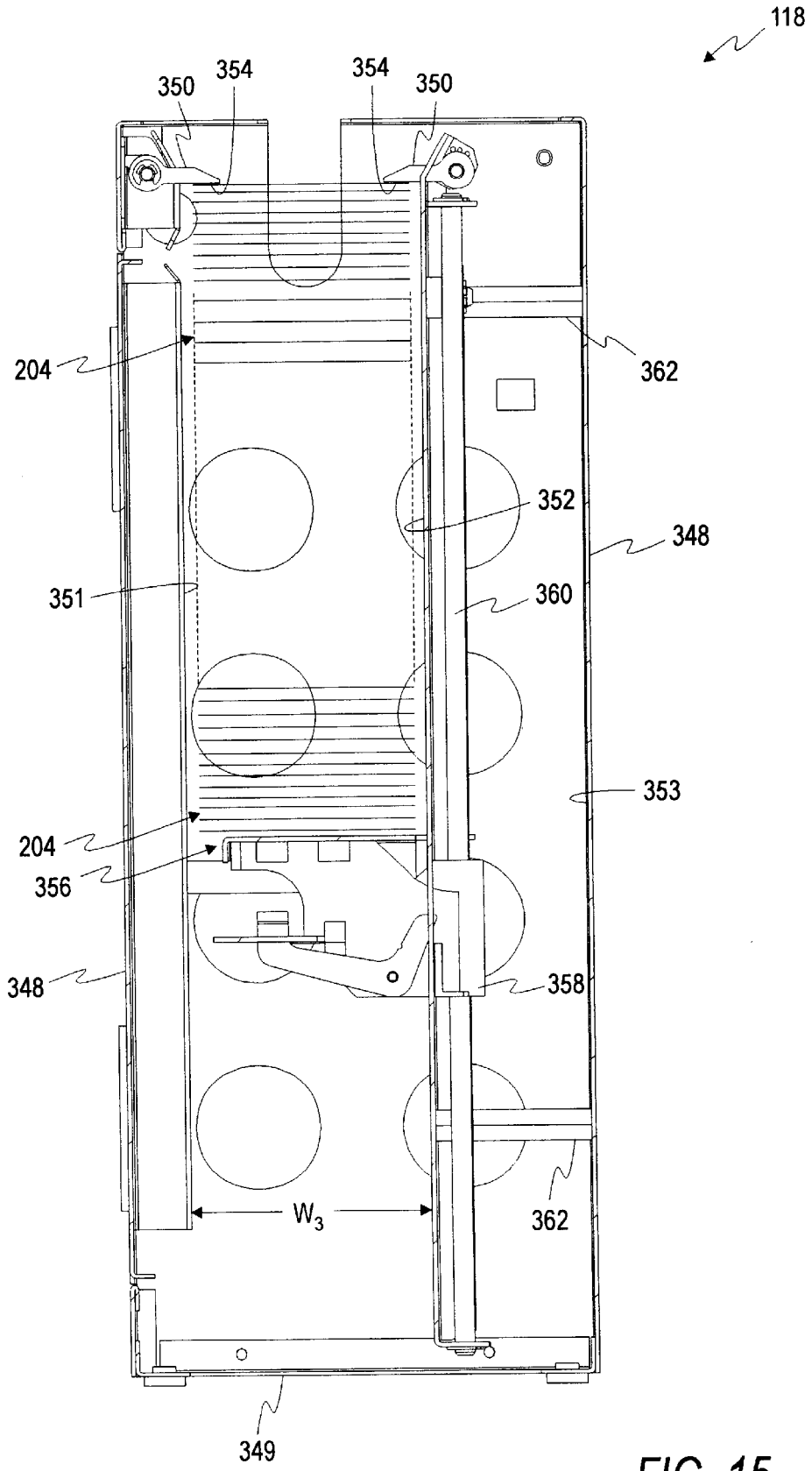
FIG. 15 is a rear view of a storage cassette according to one embodiment of the document handling device of the present invention.
Figure 16:
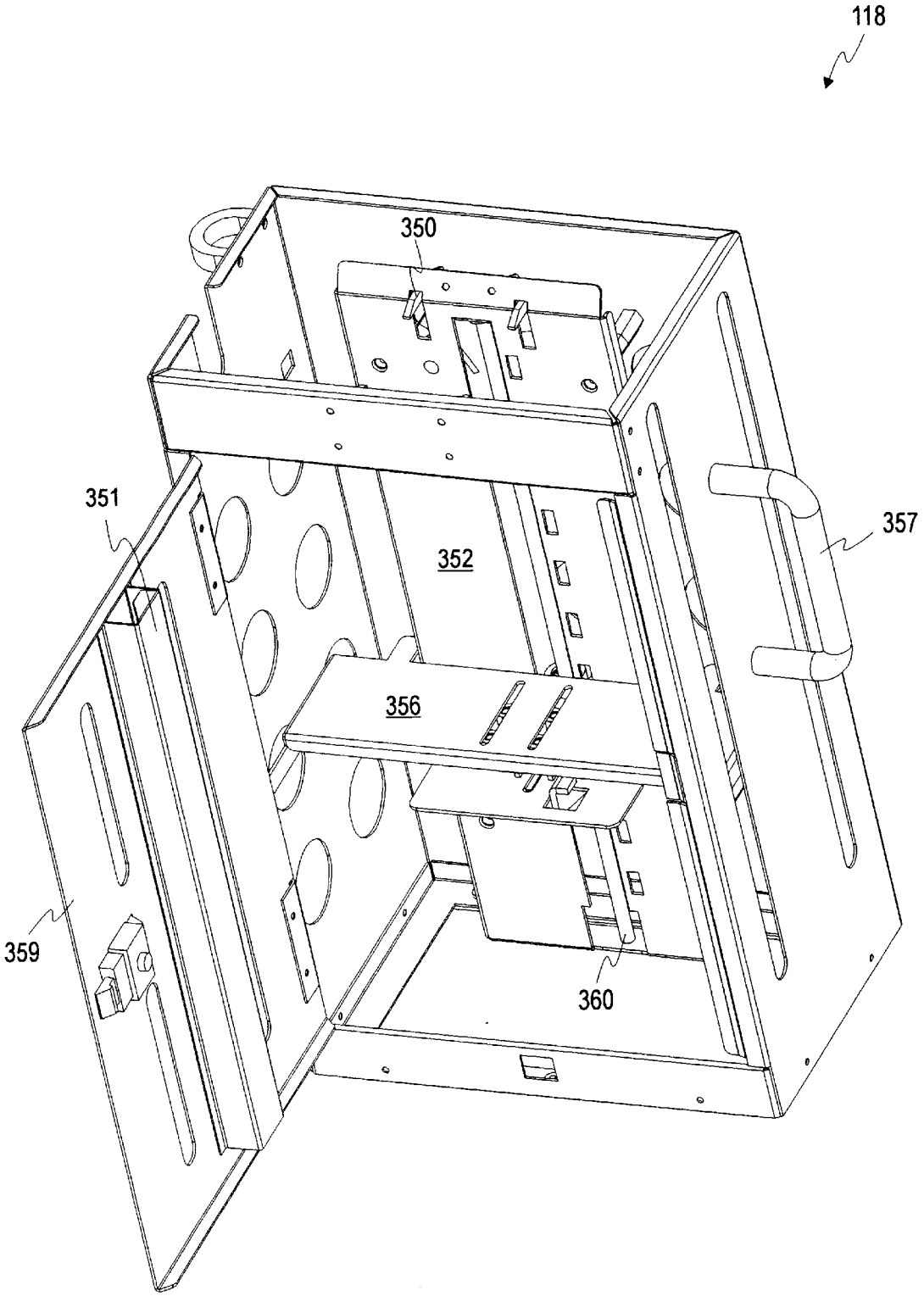
FIG. 16 is a perspective view of a storage cassette where the door is open according to one embodiment of the document handling device of the present invention.

FIGS. 14, 15, and 16 illustrate the components of the storage cassettes 118. The bills 204 are stored within the cassette housing 348 which has a base 349. Each storage cassette 118 contains two pairs of retaining tabs 350 positioned adjacent to the interior walls 351, 352 of the storage cassette. The lower surface 354 of each tab 350 is substantially planar. The tabs 350 are hingedly connected to the storage cassette 118 enabling the tabs 350 to downwardly rotate from a horizontal position, substantially perpendicular with the side interior walls 351, 352 of the cassette 118, to a vertical position, substantially parallel to the interior walls 351, 352 of the cassette 118. The tabs 350 are coupled to springs (not shown) to maintain the tabs in the horizontal position.

The storage cassette 118 contains a slidable platform 356 which is biased upward. During operation of the currency handling system 100, the platform 356 receives stacks of bills from the escrow compartment 116. The floor 356 is attached to a base 358 which is slidably mounted to a vertical support member 360. The base 358 is spring-loaded so that it is biased upward and in turn biases the platform 356 upward. The storage cassettes 118 are designed to be interchangeable so that once full, a storage cassette can be easily removed from the currency handling device 100 and replaced with an empty storage cassette 118. In the illustrated embodiment, the storage cassette 118 is equipped with a handle 357 in order to expedite removal and/or replacement of the storage cassettes 118. Also in the illustrated embodiment, the storage cassette 118 has a door 359 which enables an operator to remove bills from the storage cassette 118

Figure 17A:
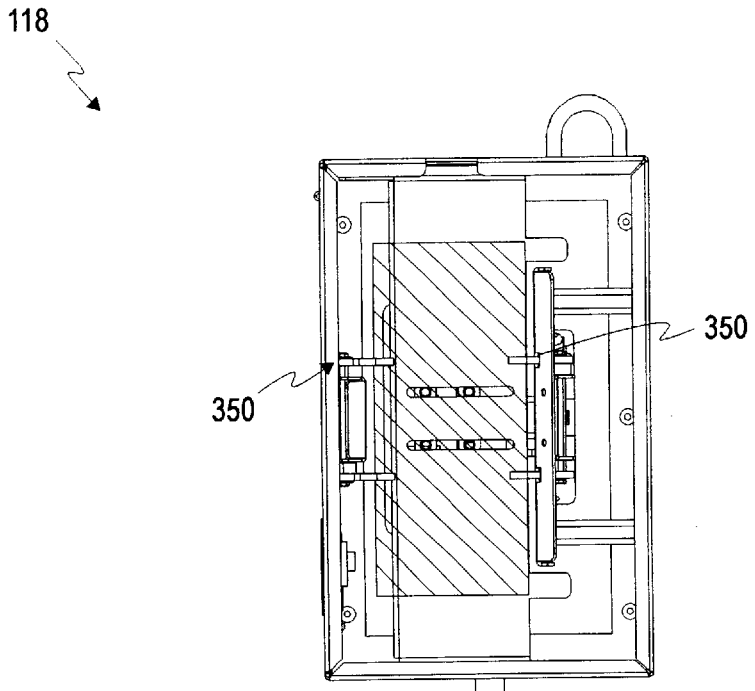
FIG. 17*a* is a top view of a storage cassette sized to accommodate United States currency documents according to one embodiment of the document handling device of the present invention.
Figure 17B:
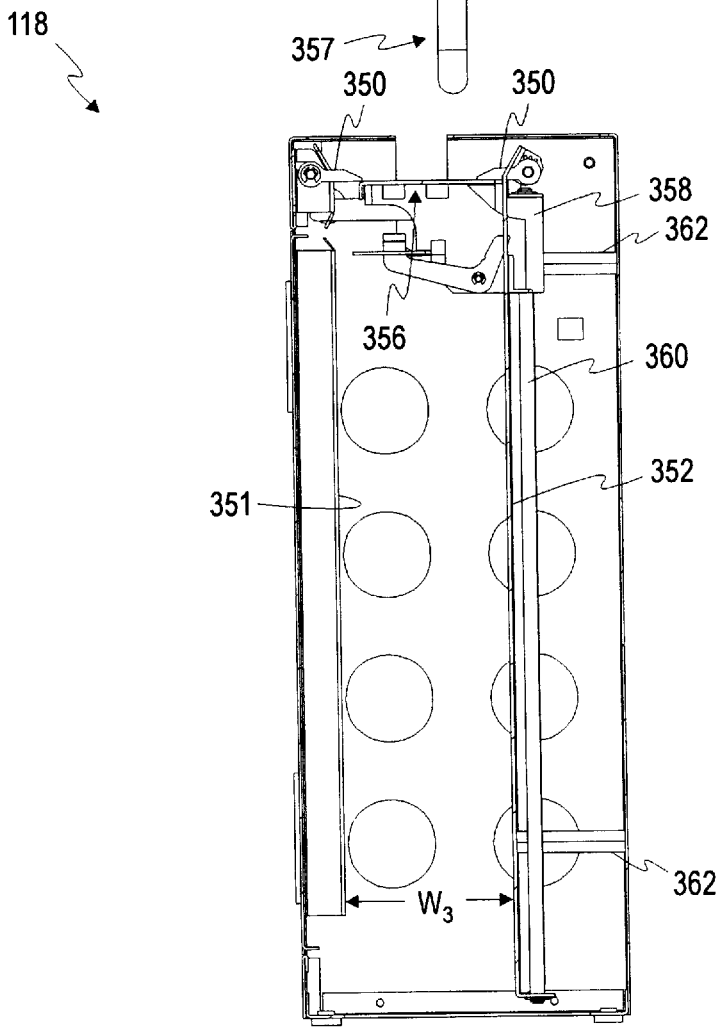
FIG. 17*b* is a rear view of a storage cassette sized to accommodate United States currency documents according to one embodiment of the document handling device of the present invention.
Figure 18A:
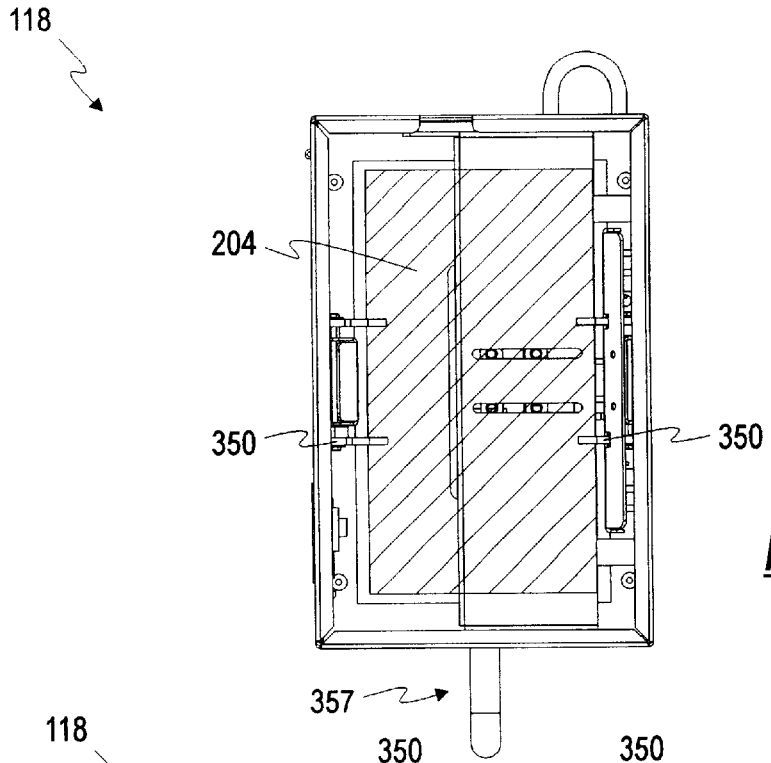
FIG. 18*a* is a top view of a storage cassette sized to accommodate large documents according to one embodiment of the document handling device of the present invention.
Figure 18B:
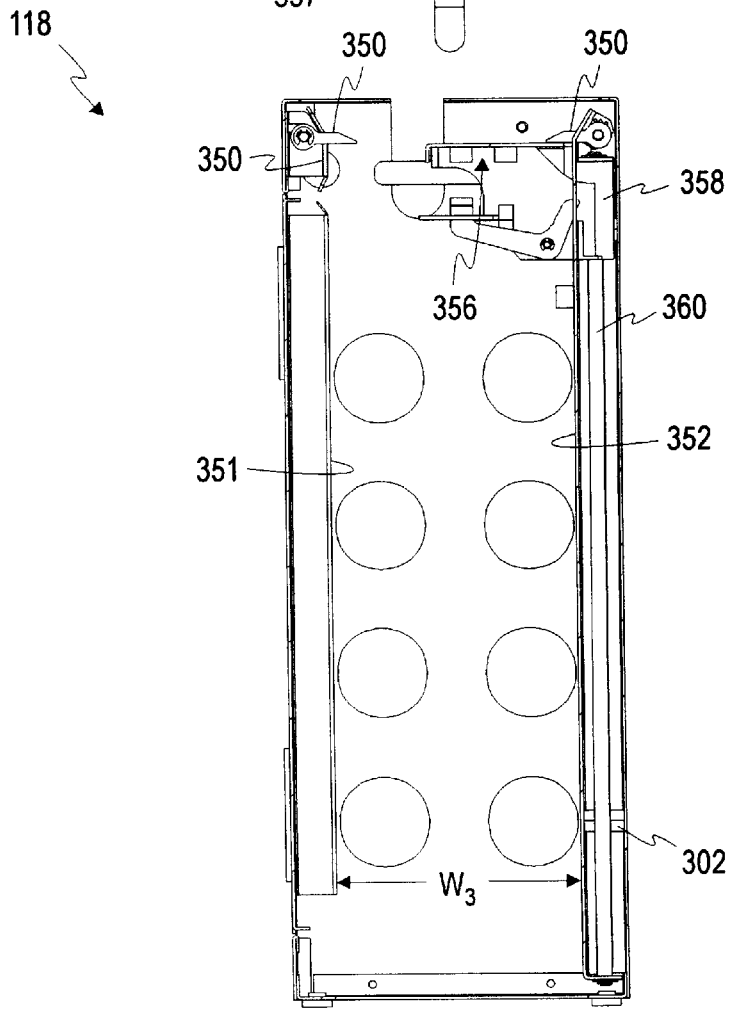
FIG. 18*b* is a rear view of a storage cassette sized to accommodate large documents according to one embodiment of the document handling device of the present invention.

The storage cassettes 118 are dimensioned to accommodate documents of varying sizes. In the illustrated embodiment, the storage cassettes 118 has a height, $H_2$, of approximately 15.38 inches (39 cm), a depth, $D_2$, of approximately 9 inches (22.9 cm), and a width, $W_2$, of approximately 5.66 inches (14.4 cm). The storage cassette illustrated in FIG. 15 has stand-offs 362 to set interior wall 352 off a fixed distance from in the interior wall 353 of the cassette housing 348. The interior walls 351, 352 aid in aligning the bills in a stack within the storage cassettes. The embodiment of the storage cassette illustrate in FIG. 15 is sized to accommodate United States currency documents. To properly accommodate United States currency documents, the interior width of the storage cassette, $W_3$, is approximately 2.88 inches. FIGS. 17*a* and 17*b* also illustrate an embodiment of the storage cassette 118 sized to accommodate U.S. currency documents which have a width of approximately 2.5 inches (approximately 6.5 cm) and a length of approximately 6 inches (approximately 15.5 cm). In alternative embodiments, the length of the stand-offs 362 can be varied to accommodate documents of varying sizes. For example, the embodiment disclosed in FIG. 18*a* and 18*b* has an interior width, $W_3$ of approximately 4.12 inches (104.6 cm) and is sized to accommodate the largest international currency, the French 500 Franc note, which has width of approximately 3.82 inches (9.7 cm) and a length of approximately 7.17 inches (18.2 cm). In order to accommodate large documents and increase the interior width, $W_3$, of the storage cassette 118, the lengths of stand-offs 362, illustrated in FIG. 16*b*, are shortened.

Beginning with FIG. 7, the operation of one of the lower output receptacles 106*c*–106*h* will be described. Pursuant to a mode of operation, the bills 204 are directed by one of the diverters 130 into the escrow compartment 116 of the lower output receptacle. The stacker wheel 202 within escrow compartment 116 receives the bills 204 from the diverter 130. The stacker wheel 202 stacks the bills 204 on top of the gate 210. Pursuant to a preprogrammed mode of operation, once a predetermined number of bills 204 are stacked in the escrow compartment 116, the control unit 120 instructs the currency handling device 100 to suspend processing currency bills and the paddle 302 then descends from its home position above the escrow compartment 116 to transfer the bills 204 into the storage cassette 118. Once the bills 204 have been deposited in the storage cassette 118 the currency handling device resumes operation until an escrow compartment is full or all the bills within the input receptacle 102 have been processed.

Referring now to FIGS. 8 and 9 the plunger assembly 300 downwardly travels placing the paddle 302 onto of the stack of bills 204. Upon making contact with the bills 204 the paddle 302 continues to travel downward. As the paddle 302 continues its descent, the paddle 302 forces the gate 210 to snap open. The paddle 302 imparts a force to the bills 204 that is transferred to the to the shutters 211, 212 causing the shutters 211, 212 to rotate from the closed position to the open position. The rotation of the shutters 211, 212 is indicated by the arrows B and C, respectively. Once the paddle 302 imparts the amount of force necessary to rotate levers 216, 217, the extension springs 218, 219 quickly rotate the shutters 211, 212 downward, thus "snapping" the gate 210 open. The downward rotation of the shutters 211, 212 causes each of the corresponding parallel bars 214, 215 to pivot which in turn rotates the levers 216, 217. The extension springs 218, 219 maintain the shutters 211, 212 in the open position allowing the paddle 302 to descend into the storage cassette 118. The hingedly connected side arms 306, 308 retract as the rollers 316, 318 to roll around the levers 216, 217 while the plunger assembly 300 is traveling downward into the cassette 118.

Referring now to FIG. 15, once the gate 210 is opened, the bills 204 fall a short distance onto the platform 356 of the storage cassette 118 or onto a stack of bills 204 already deposited on the platform 356. The paddle 302 continues its downward motion towards the storage cassette 118 to ensure that the bills 204 are transferred to the cassette 118. Initially, some bills 204 may be spaced apart from the platform 356 or the other bills 204 within the storage cassette by retaining tabs 350. As the plunger assembly 300 continues to descend downward into the cassette, the paddle 302 continues to urge the stack of bills 204 downward causing the retaining tabs 350 to rotate downward. The bills 204 are pushed past retaining tabs 350 and onto the platform 356.

Once the plunger assembly 300 has descended into the cassette 118 a distance sufficient for the paddle 302 to clear the retaining tabs 350 allowing the retaining tabs 350 to rotate upward, the plunger assembly initiates its ascent out of the storage cassette 118. The platform 356 urges the bills 204 upward against the underside of the paddle 302. The paddle 302 is equipped with two pairs of slots 324, 326 (FIG. 9) to enable the paddle to clear the pairs of retaining tabs 350. When the paddle 302 ascends past the pairs of retaining tabs 350 the bills 204 are pressed against the lower surfaces 354 of the pairs of retaining tabs 350 by the platform 356.

Referring now to FIG. 13, when the plunger assembly 300 is traveling upward out of the cassette 118, the rollers 316, 318 on the side arms 306, 308 engage the respective levers 216, 217 and move the respective levers 216, 217 from the second (open) position to the first (closed) position to move the gate 210 from the open position to the closed position as the paddle 302 ascends into the escrow compartment 116 after depositing the bills 204 in the storage cassette 118. The paddle 302 is mounted on the base 304 above the rollers 316, 318 on the side arms 306, 308 so that the paddle 302 clears the gate 210 before the gate 210 is moved to the closed position.

In alternative embodiments of the currency handling device 100, the output receptacles 106 can be sized to accommodate documents of varying sizes such as various international currencies, stock certificates, postage stamps, store coupons, etc. Specifically, to accommodate documents of different widths, the width of the escrow compartment 116, the gate 210, and the storage cassette 118 would need to be increased or decreased as appropriate. The document evaluation device 100 is sized to accommodate storage cassettes 118 and gates 210 of different widths. The entire transport mechanism 104 of the currency handling device 100 is dimensioned to accommodate the largest currency bills internationally. Accordingly, the document handling device 100 can be used to process the currency or documents of varying sizes.

In various alternative embodiments, the currency handling device 100 is dimensioned to process a stack of different sized currencies at the same time. For example, one application may require the processing of United States dollars (2.5 inches×6 inches, 6.5 cm×15.5 cm) and French currency (as large as 7.17 inches×3.82 inches, 18.2 cm×9.7 cm). The application may the U.S. currency from the French currency wherein the currency handling device 100 delivers U.S. currency to the first lower output receptacle 106*c* and the French currency to the second output receptacle 106*d*. In another alternative embodiment, the currency handling device 100 processes a mixed stack of U.S. ten and twenty dollar bills and French one hundred and two hundred Franc notes wherein the currency documents are denominated, counted, and authenticated. In that alternative embodiment, the U.S. ten and twenty dollar bills are delivered to the first 106*c* and second 106*d* lower output receptacles, respectively, and the French one hundred and two hundred Franc notes are delivered to the third 106*e* and fourth 106*f* lower output receptacle, respectively. In other alternative embodiments, the currency handling device 100 denominates, counts, and authenticates six different types of currency wherein, for example, Canadian currency is delivered to the first lower output receptacle 106*c*, United States currency is delivered to the second output receptacle 106*d*, Japanese currency is delivered to the third lower output receptacle 106*e*, British currency is delivered to the fourth lower output receptacle 106*f*, French currency is delivered to the fifth lower output receptacle 106*g*, and German currency is delivered to the sixth lower output receptacle 106*h*. In another embodiment, no call bills or other denominations of currency, such as Mexican currency for example, may be directed to the second upper output receptacle 106*b*. In another embodiment, suspect bills are delivered to the first upper output receptacle 106*a*.

In other alternative embodiments of the currency handling device 100, the user can vary the type of documents delivered to the output receptacles 106. For example, in one alternative embodiment an operator can direct, via the control unit 120, that a stack of one, five, ten, twenty, fifty, and one-hundred United States dollar bills be denominated, counted, authenticated, and directed into lower output receptacles 106*c*–106*h*, respectively. In still another alternative embodiment, the currency handling device 100 is also instructed to deliver other bills, such as a United States two dollar bill or currency documents from other countries that have been mixed into the stack of bills, to the second upper output receptacle 106*b*. In still another alternative embodiment, the currency handling device 100 is also instructed to count the number and aggregate value of all the currency bills processed and the number and aggravate value of each individual denomination of currency bills processed. These values can be communicated to the user via the display/user-interface 122 of the currency handling device 100. In still another alternative embodiment, no call bills and bills that are stacked upon one another are directed to the second upper output receptacle 106*b*. In still another alternative embodiment, the operator can direct that all documents failing an authentication test be delivered to the first upper output receptacle 106*a*. In another alternative embodiment, the operator instructs the currency handling device 100 to deliver no call bills, suspect bills, stacked bills, etc. to one of the lower output receptacles 106*c*–106*h*. The currency handling device 100 which has eight output receptacles 106*a*–106*h* provides a great deal of flexibility to the user. And in other alternative embodiments of the currency handling device 100, numerous different combinations for processing documents are available.

According to one embodiment, the various operations of the currency handling device 100 are controlled by processors disposed on a number of printed circuit boards ("PCBs") such as ten PCBs located throughout the device 100. In one embodiment of the present invention, the processors are Motorola processors, model number 86HC 16, manufactured by Motorola, Inc. of Schaumburg, Ill. Each of the processors are linked to a central controller via a general purpose communications controller disposed on each PCB. In one embodiment of the present invention the communications controller is an ARCNET communications controller, model COM20020, manufactured by Standard Microsystems Corporation of Hauppauge, N.Y. The communications controller enables the central controller to quickly and efficiently communicate with the various components linked to the PCBs.

According to one embodiment, two PCBs, a "motor board" and a "sensor board," are associated with each pair of lower output receptacles 106*c*–106*h*. The first two lower output receptacles 106*c,d*, the second two lower output receptacles 106*e,f*, and the last two lower output receptacles 106*g,h* are paired together. Each of the lower output receptacles 106 contain sensors which track the movement of the bills into the lower output receptacles 106*c*–106*h*, detect whether each storage cassette 118*a*–118*e* is positioned within the currency handling device 100, detect whether the doors 359 of the storage cassettes 118 are opened or closed, and whether the cassettes 118 are full. These aforementioned sensors associated with each pair of the lower output receptacles are tied into a sensor board which is linked to the central controller. The operation of the plunger assembly 300, the stacker wheels 202, the portion of transportation mechanism 104 disposed above the lower output receptacles 116*c*–116*h*, and the diverters 130 are controlled by processors disposed on the motor board associated with each pair of lower output receptacle's 106*c*–106*h*. Those sensors 130 which track the movement of bills along the transportation mechanism 104 that are disposed directly above the lower output receptacles 106*c*–106*h* are also tied into the respective motor boards.

One of the four remaining PCBs is associated with the operation of the one or two stacker wheels 127 associated with the upper output receptacles 106*a,b*, the stripping wheels 140, the primary drive motor of the evaluation region 108, a diverter which direct bills to the two upper output receptacles 106*a,b*, and the diverter which then directs bills between the two upper output receptacles 106*a,b*. The remaining three PCBs are associated with the operation of the transport mechanism 104 and a diverter which directs bills from the transport path to the bill facing mechanism 110 . The plurality of sensors 130 disposed along the transport mechanism 104, used to track the movement of bills along the transport mechanism 104, also tied into these three remaining PCBs.

During the lifetime of prior art currency handling devices it is likely that individual key components of the devices, including components specific to the output receptacles, will degrade and eventually fail. The failure of an individual component specific to an output receptacle can render that output receptacle inoperable. The inoperability of one of the output receptacles of prior art currency handling devices can render the entire device inoperable regardless of whether the remaining output receptacles are otherwise properly functioning. Component failures resulting in the inoperability of the entire device can have a devastating effect on the cash handling operations of users of these devices. The inventors of the present invention have found that currency handling devices play a vital role in the overall operation of a cash vault, including cash vaults at banks or casinos. The inventors estimate that over 90% (ninety percent) of the cash handled within a cash vault is processed by a currency handling device. Therefore, the failure of a currency handling device can have a disastrous effect on the operation of a cash vault or other operations relying on the performance of the currency handling device.

Like prior art currency handling devices, it is anticipated that over the extended lifetime of the currency handling device 100 components of the device 100, including components specific to the output receptacles 106, will degrade and eventually fail. Such individual components include, for example, the motor 330 (FIG. 11), the belt 328 (FIG. 11), sensors such as the bill passage sensors 119, solenoids, switches that indicate a cassette 118 is properly inserted into an output receptacle 106, and other electrical or mechanical components of the output receptacles 106. However, the currency processing device 100 of the present invention implements a backup routine to remedy the failure of a component(s) of an output receptacle 106 which would otherwise render the currency handling device 100 inoperable. The inventors of the present invention use the term "disable pockets" to describe this backup routine which essentially disables one or more output receptacles 106 (also called a "pocket") in which component failure(s) have occurred.

Upon the failure of a component within one of the output receptacles, the user of the currency handling device 100 is informed of the error via the user interface 112. For example, each of the lower output receptacles 106*c–h* contains a switch (not shown) that is tripped when a cassette 118 is properly inserted into the output receptacle 106. Under normal circumstances, the control unit 120 detects the tripped switch upon proper insertion of a cassette 118 into the output receptacle 106 and the currency handling device 100 operates as intended. When a cassette 118 is improperly inserted, the control unit 120 does not detect the presence of a properly inserted cassette 118 and the user is prompted via the user interface 122. Upon a visual inspection or physical manipulation of the storage cassette 118, the operator can quickly determine whether the cassette 118 is properly inserted within the output receptacle 106. If the operator determines the cassette 118 is properly inserted and the error signal indicating otherwise is itself an error, the operator can implement the disable pockets routine via the user interface 122.

The implementation of the disable pockets routine will cause the control unit 120 to ignore the error conditions associated with the output receptacle 106 experiencing component failure by essentially shutting down that output receptacle, allowing the currency handling device 100 to operate with one less lower output receptacle 106*c–h*. For example, disabling the first lower output receptacle 106*c* will cause the currency handling device 100 to operate as though the device 100 has five lower output receptacles—the second lower output receptacle 106*d* through the sixth lower output receptacle 106*h*. Those bills normally directed to the first lower output receptacle 106*c* are now, pursuant to the disable pockets routine, directed to another one of the output receptacles 106 such as the first or second upper output receptacles 106*a–b*. In other embodiments of the device 100, more than one lower output receptacle 106*c–h* may be disabled. For example, disabling the first two lower output receptacles 106*c–d* will cause the currency handling device 100 to operate with four lower output receptacles—the third lower output receptacle 106*e* through the sixth lower output receptacle 106*h*.

According to one embodiment of the disable pockets routine, those bills which would normally be directed to the inoperable output receptacle(s) are now directed to the output receptacle to which bills triggering error conditions (e.g., no call bills) are directed pursuant to various modes of operation. The disable pockets routine is designed to work with existing modes of operation (or other user-defined modes of operation) such as, for example, those modes of operation incorporated by reference above from U.S. patent application Ser. No. 08/916,100 as well as disclosed in International Patent Application Publication No. WO 99/09511, both of which are incorporated herein by reference in their entireties. Put another way, the disable pockets routine compliments the user-selected mode of operation by directing bills otherwise directed to the disabled output receptacle to an alternative output receptacle.

In one embodiment of the disable pockets routine directs the bills otherwise directed to the disabled output receptacle to an output receptacle 106 to which bills triggering error conditions are directed pursuant to the current mode of operation of the currency handling device 100. By way of example, one mode of operation may direct bills triggering a "no call" error condition to the second lower output receptacle 106*b* while directing U.S. $1 bills to the first lower output receptacle 106*c*. Upon disabling the first lower output receptacle 106*c*, $1 bills are automatically directed to the no call output receptacle 106*b* which is the second lower output receptacle. During operation of the device 100, both no call bills and identifiable $1 bills are directed to the second lower output receptacle 106*b*. The device 100 can suspend operation when a no call bill is delivered into the second upper output receptacle 106*b* giving the operator the opportunity to remove the no call bills from the identifiable $1 bills. Alternatively, all bills triggering error conditions may be directed to the first upper output receptacle 106*a* and $1 bills are directed to the second lower output receptacle 106*b*. In other alternative embodiments, after one or more of the output receptacles 106 is disable, the user is prompted to select which of the remaining output receptacles 106 are to replace the disabled output receptacle 106. The user may designate that U.S. $1 bills be directed to the sixth lower output receptacle along with U.S. $5 bills for example. Many of the modes of operation direct no call bills to one of the upper output receptacles 106*a,b*. However, in alternative embodiments of the present invention, bills triggering error conditions can be directed into any one of the plurality of output receptacles 106.

Figure 19:
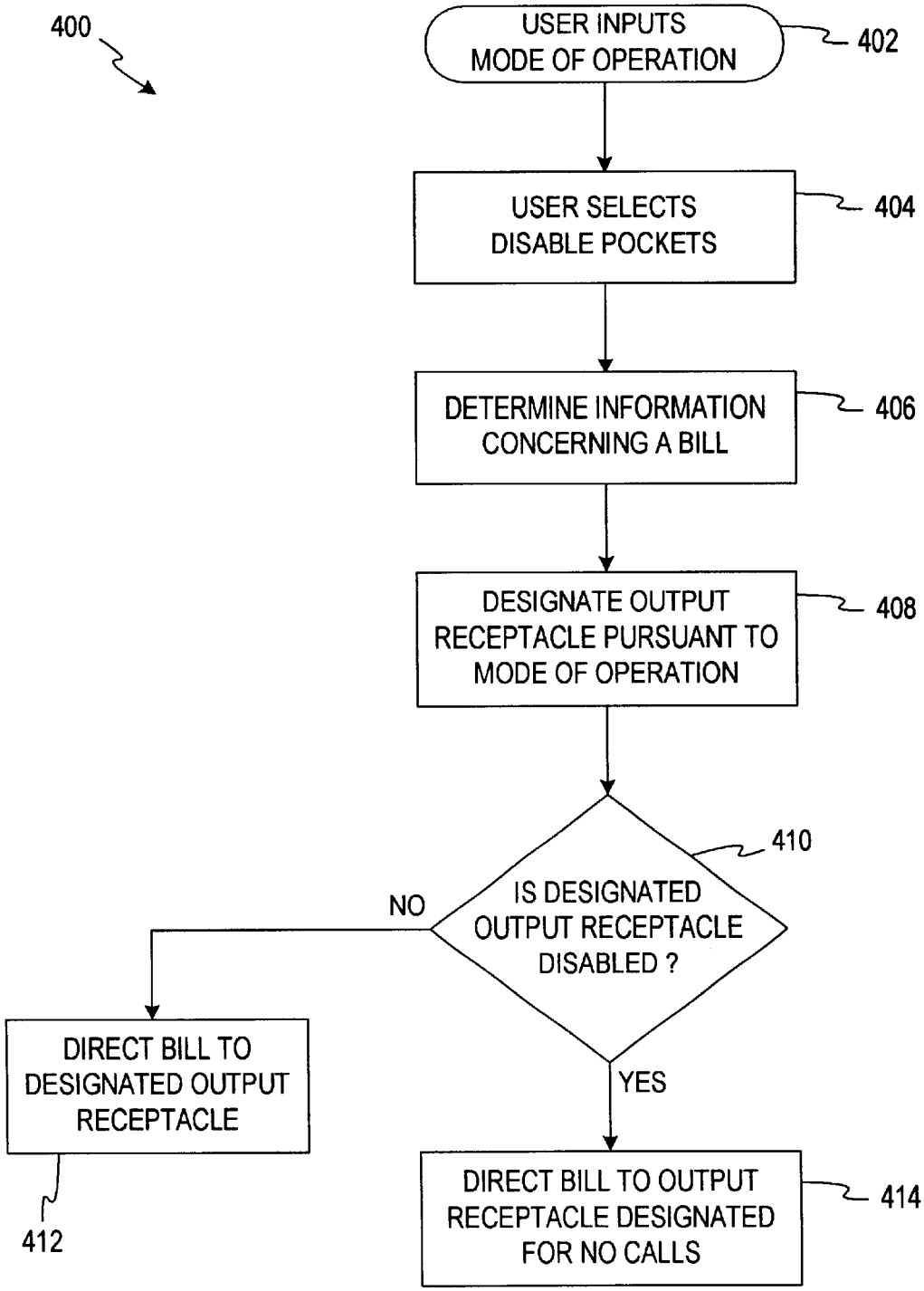
FIG. 19 is a flow chart of the disable pockets routine according to one embodiment of the document handling device of the present invention.
Figure 21:
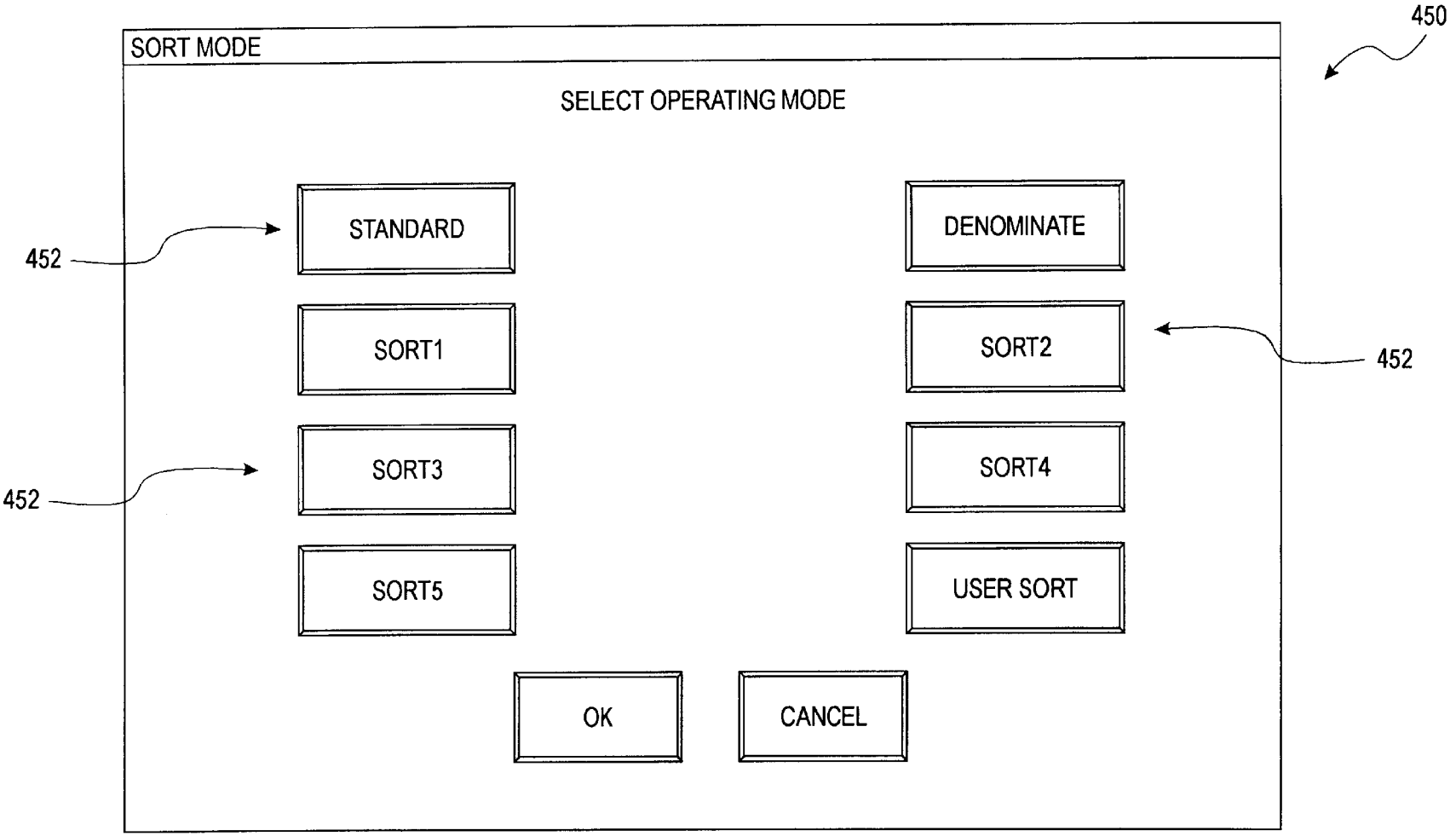
FIGS. 21–23 are illustrative screens that are displayed on a user interface pursuant to the disable pockets routine according to one embodiment of the document handling device of the present invention.
Figure 22:
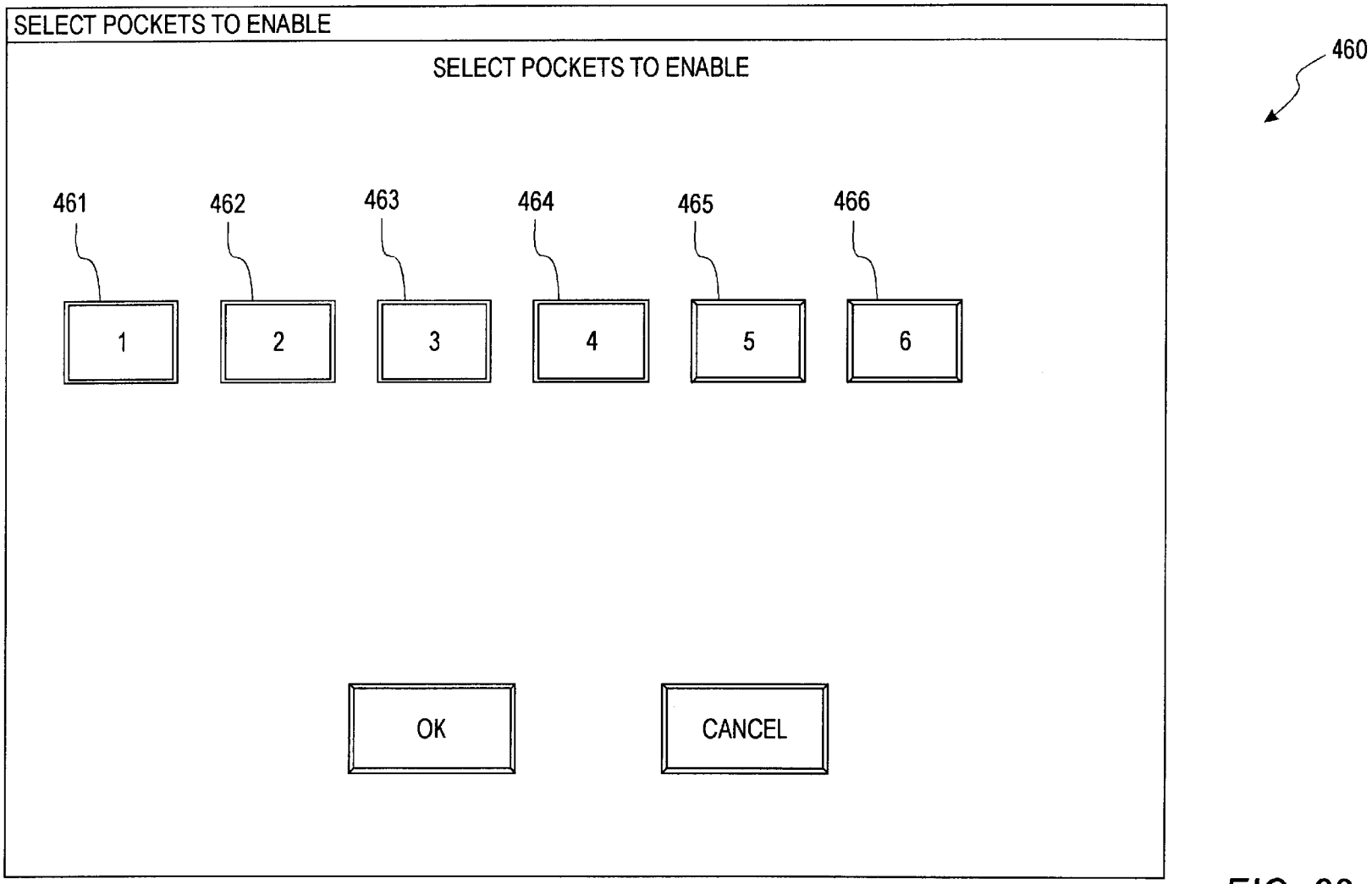
Figure 23:
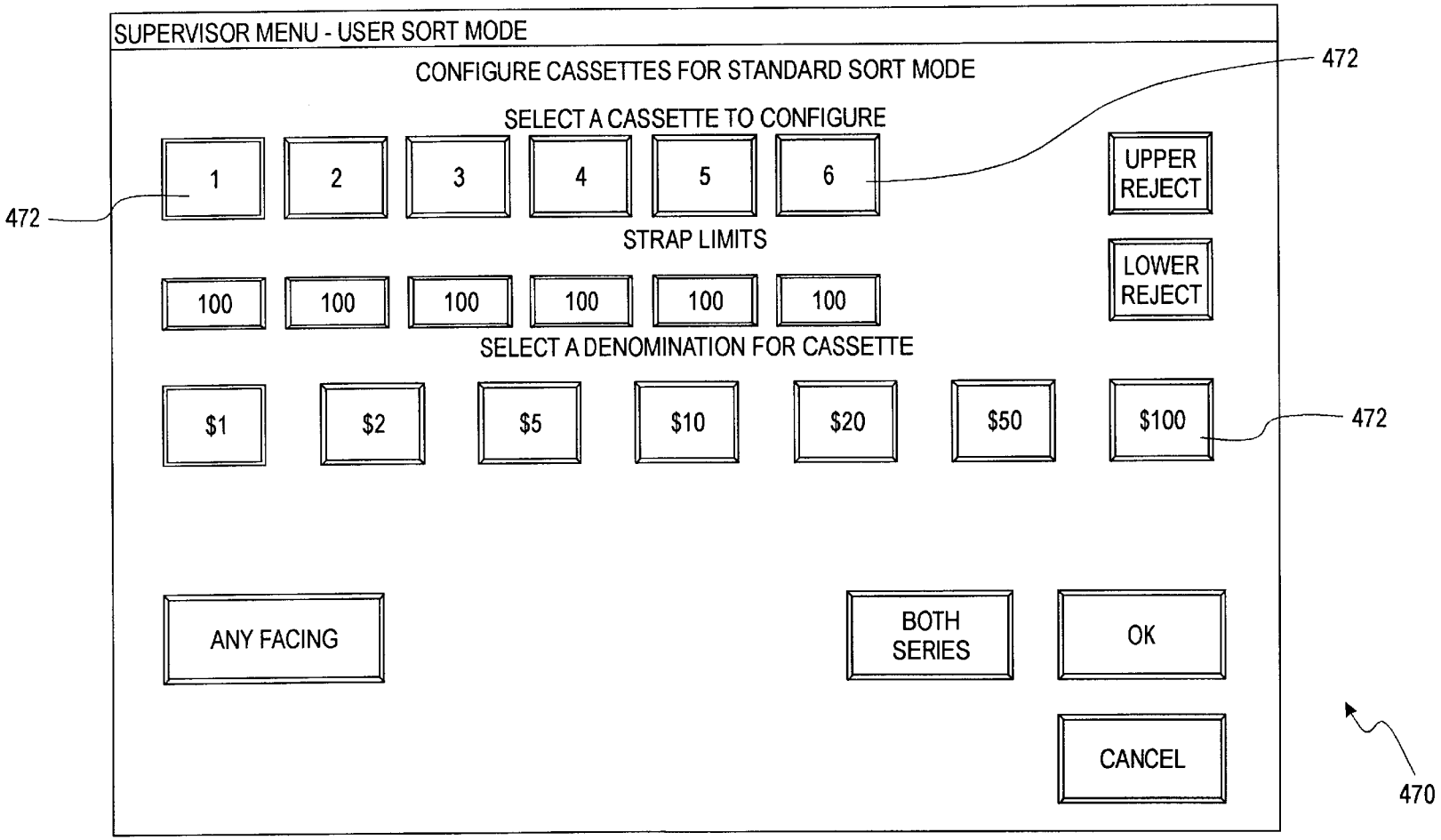

Referring now to FIG. 19, the operation of the currency handling device 100 pursuant to one embodiment of the disable pockets routine 400 will be described. Before implementing the disable pockets routine, the user of the currency handling device 100 determines that it is necessary to disable of one or more of the output receptacles 106 of the device 100. Upon deciding to process a batch of currency bills, the user inputs or selects (via the user interface 122) a mode of operation at step 402. An illustrative screen 450 which may be displayed on the user interface 122 is illustrated in FIG. 21. The user can select one of a plurality of buttons 452 corresponding to the desired mode of operation. This step 402 may also include assigning denominations and strap limits to a specific mode of operation by selecting buttons 472 as shown in the illustrative screen 470 of FIG. 22. The currency handling device 100 is able to process bills according to a strapping mode of operation as described in co-pending U.S. patent application Ser. No. 09/635,181 entitled "Method of Creating Identifiable Smaller Stacks of Currency Bills within a Larger Stack of Currency Bills," which was filed on Aug. 8, 2000 and is incorporated herein by reference in its entirety. At step 404, the user instructs the device 100 to disable one of the output receptacles 106. This may include designating the specific output receptacle(s) 106 to be enabled and which output receptacle(s) 106 to be disabled. An illustrative screen 460 which may be displayed on the user interface 122 is illustrated in FIG. 23. According to the illustrative screen 460 of FIG. 22, buttons 461–464 have been selected thus enabling the first four lower output receptacles 106*c–f* while buttons 465–466 have not been selected thus disabling the fifth and sixth lower output receptacles 106*g–h*. Alternatively, the disable pockets routine automatically disables the inoperable output receptacle (s) 106. Thereafter, the operation of the currency handling device 100 commences. As each bill is transported though the evaluation region 108, information concerning each bill is determined at step 406. Such information can include denomination, currency type, or authenticity. Next, based on the determined information concerning the bill, an output receptacle 106 to which the device 100 normally transports that bill is designated at step 408. The designated output receptacle 106 is determined pursuant to the particular mode of operation. For example, a particular mode of operation may designate the first lower output receptacle 106*c* for U.S. $1 bills and the second lower output receptacle 106*d* for $1 Canadian bills. The designated output receptacle (designated pursuant to the mode of operation) is checked against the disabled output receptacle (disable pursuant to the disable pockets routine) at step 408. If the designated output receptacle 106 is not the disabled output receptacle, the bill is directed to the designated output receptacle 106 at step 412. If the designated output receptacle is the disabled output receptacle, the bill is directed to the output receptacle designated for no call bills—typically, one of the two upper output receptacles 106*a,b* is designated for no calls.

Figure 20:
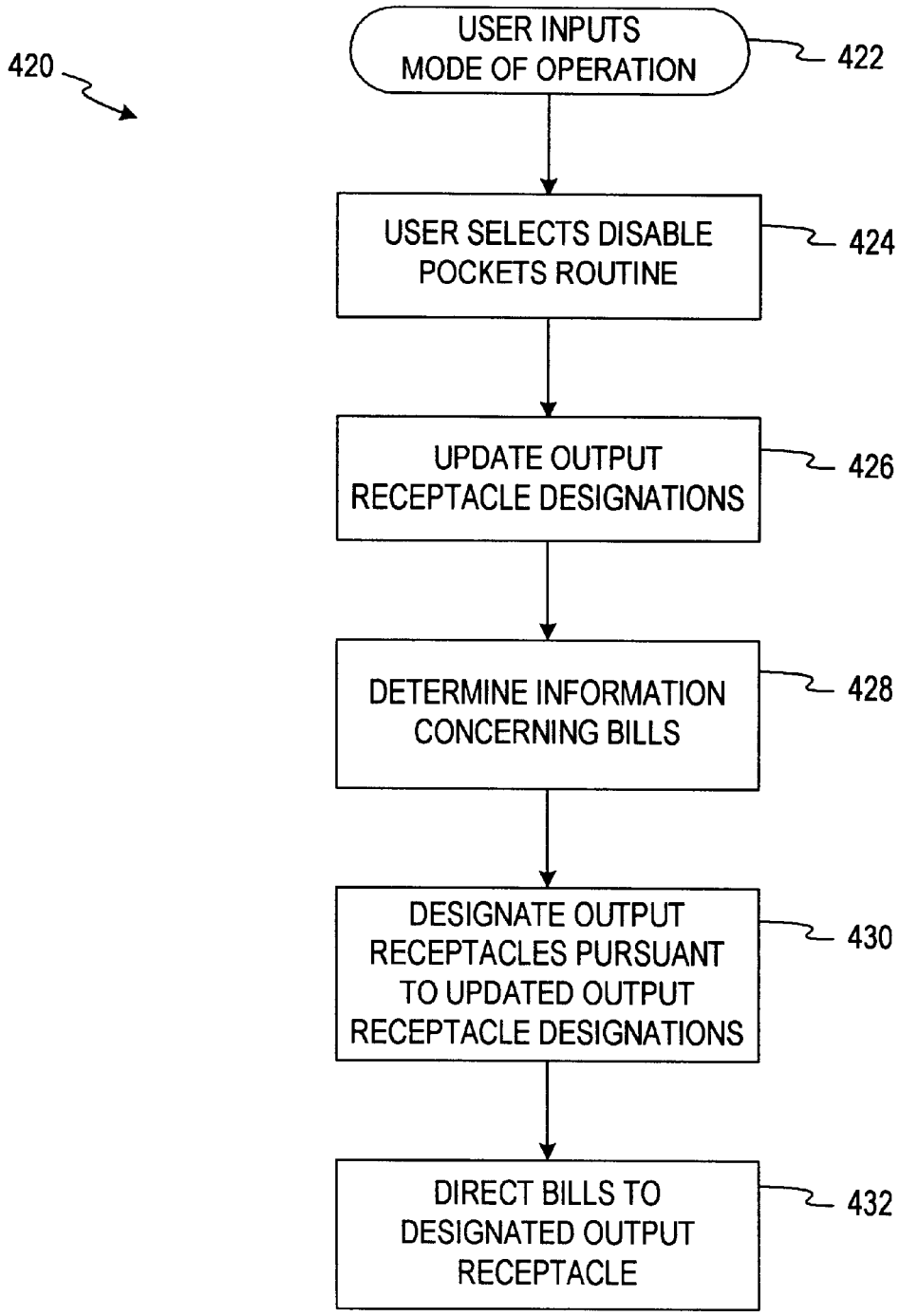
FIG. 20 is a flow chart of the disable pockets routine according to an alternative embodiment of the document handling device of the present invention.

Referring now to FIG. 20, the operation of the currency handling device pursuant to another embodiment of the disable pockets routine 420 will be described. Again, before implementing the disable pockets routine 420, the user of the currency handling device 100 determines that it is necessary to disable of one or more of the output receptacles 106 of the device 100. Upon deciding to process a batch of currency bills, the user inputs or selects (via the user interface 122) a mode of operation at step 422. At step 424, the user instructs the device 100 to disable one or more of the output receptacles 106. According to alternative embodiments, steps 422 and 424, or steps 402 and 404 with regard to FIG. 19, can be performed in the reverse order. Again, step 424 may include designating the specific output receptacle(s) to be disabled. Alternatively, the disable pockets routine 420 at step 424 automatically disables the inoperable output receptacle(s). At step 426, the output receptacle designations pursuant to the selected mode of operation (e.g., U.S. $10 bills are directed to the third lower output receptacle 106*e*) are updated to reflect the disabling of the output receptacle (s). For example, pursuant to one mode of operation, the third lower output receptacle 106*e* is designated to receive U.S. $10 bills and the second upper output receptacle 106*b* may be designated to receive no call bills. At step 426, the designation of the second upper output receptacle 106*b* is updated to include U.S. $10 bills. In one embodiment of the disable pockets routine 420, the disabled output receptacles are replaced with those output receptacles 106 assigned to bills triggering error conditions (e.g., no calls) are directed such as either of the two upper output receptacles 106*a–b*. Alternatively, step 426 may include selecting the particular output receptacle(s) 106 to replace the disabled output receptacles. Thereafter, the operation of the output receptacles is commenced. At step 428, information concerning each of the bills is determined such bill denomination. The determined information is used to designate to which output receptacle a particular bill will be directed at step 432. For example, bills determined to be U.S. $100 bills are directed to lower output receptacles 106*h*. And at step 432, the device 100 directs the bill to the designated output receptacle 106.

Pursuant to one mode of operation, an operator can direct, via the control unit 120 at step 402, that a batch of bills be processed such that stacks of U.S. $1, $5, $10, $20, $50, and $100 bills are denominated, counted, authenticated, and directed into lower output receptacles 106*c*–106*h*, respectively. Other bills such as U.S. $2 bills, currency bills from other countries that have been mixed into the batch of bills, and non-identifiable bills (e.g., no calls) are directed to the second upper output receptacle 106*b*. Lastly those U.S. $1, $5, $10, $20, $50, and $100 bills determined to be non-authentic (e.g., suspect documents) are directed to the first upper output receptacle 106*a*. The above-described mode of operation is simply one example of the manner in which the currency handling machine 100 processes currency bills. The currency handling device 100 having eight output receptacles 106*a*–106*h* provides a great deal of flexibility to the user. And in other alternative embodiments of the currency handling device 100, numerous different combinations for processing documents are available. Upon a user implementing the disable pockets routine, an output pocket—the first lower output receptacle 106*c*, for example—is disabled. Accordingly, during the processing of each of the bills in the batch are processed as described above except that U.S. $1 bills are directed into the second upper output receptacle 106*b* along with those bill determined to be strangers.

As indicated above, in alternative embodiments of the disable pockets routine, the user can designate the output receptacle to which the bills normally directed to one or more disabled pocket are to be directed. In such an embodiment, upon selection of the disable pockets routine, the device 100 may prompt the user via the user interface 122 to specify the alternative output receptacle(s) 106 to which to direct bills otherwise directed to the disabled output receptacle(s) 106. For example, using the above-described scenario, both U.S. $1 and $5 bills may be directed to the second lower output receptacle 106*d* when the first lower output receptacle 106*c* is disabled. Such an embodiment may be advantageous if the user anticipates a low volume of U.S. $1 and $5 bills. The user can vary the output receptacle(s) 106 to which bills otherwise directed to disabled output receptacles are directed in a manner best suited to the particular application.

The disable pockets routine provides a temporary solution to remedy of the inoperability of one of the output receptacles. The users of the currency handling device 100 can continue to process currency bills while awaiting the arrival of spare parts and/or waiting for repairs to take place.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A method of processing a plurality of currency bills with a currency handling device, the currency handling device including a transport mechanism adapted to transport each of the bills, one at a time, from an input receptacle past an evaluation unit to a plurality of output receptacles, the currency handling device includes a user-interface adapted receive input from a user of the currency handling device, the method comprising:

disabling at least one of a plurality of output receptacles;

receiving a plurality of currency bills;

transporting the bills from the input receptacle past the evaluating unit to the plurality of output receptacles;

determining information concerning each of the bills;

designating the particular one of the plurality of output receptacles to which each of the bills are transported based on the determined information concerning each of the bills;

comparing the designated output receptacle for each of the bills to the disabled output receptacle; and re-designating the particular one of the plurality of output receptacles to which each of the bills are transported to an alternative output receptacle when the designated output receptacle is the disabled output receptacle.

2. The method of claim 1 further comprising detecting the presence of an error condition within the plurality of output receptacles.

3. The method of claim 2 wherein disabling further comprises disabling the output receptacle having an error condition detected therein.

4. The method of claim 3 further comprising disabling the output receptacle having an error condition detected therein response to user input.

5. The method of claim 1 further comprising receiving input from a user of the currency handling device selecting a mode of operation from a plurality of modes of operation stored within a memory of the currency handling device, wherein the mode of operation designates the output receptacle to which each of the bills are transported based on the determined information concerning the bill.

6. The currency handling device of claim 5 wherein the alternative output receptacle is the output receptacle to which no call bills are transported pursuant to the selected mode of operation.

7. The method of claim 1 further comprising receiving input from a user of the currency handling device specifying the particular one of the plurality of output receptacles to be disabled.

8. The method of claim 1 further comprising receiving input from a user of the currency processing device specifying which of the plurality of output receptacles is the alternative output receptacle.

9. A method of processing a plurality of currency bills with a currency handling device, the currency handling device including a transport mechanism adapted to transport each of the bills, one at a time, from an input receptacle past an evaluation unit to a plurality of output receptacles, the currency handling device includes a user-interface adapted receive input from a user of the currency handling device, the method comprising:

disabling at least one of a plurality of output receptacles;

updating at least one output receptacle designation of a mode of operation to direct those bills designated to be delivered to the at least one disabled output receptacle to an alternative output receptacle;

receiving a plurality of currency bills;

transporting the bills from the input receptacle past the evaluating unit to the plurality of output receptacles;

determining information concerning each of the bills; and designating the particular one of the plurality of output receptacles to which each of the bills are transported based on the determined information concerning each of the bills.

10. The method of claim 9 further comprising detecting the presence of an error condition within the plurality of output receptacles.

11. The method of claim 10 wherein disabling further comprises disabling the output receptacle having an error condition detected therein.

12. The method of claim 11 further comprising disabling the output receptacle having an error condition detected there in response to user input.

13. The method of claim 9 further comprising receiving input from a user of the currency handling device selecting a mode of operation from a plurality of modes of operation stored within a memory of the currency handling device, wherein the mode of operation designates to the output receptacle to which each of the bills are transported based on the determined information concerning the bill.

14. The method of claim 13 wherein the alternative output receptacle is the output receptacle to which no call bills are transported pursuant to the selected mode of operation.

15. The method of claim 9 further comprising receiving input from a user of the currency handling device specifying the particular one of the plurality of output receptacles to be disabled.

16. The method of claim 9 further comprising receiving input from a user of the currency processing device specifying which of the plurality of output receptacles is the alternative output receptacle.

17. A method of processing a plurality of currency bills with a currency handling device, the method comprising:

disabling at least one of a plurality of output receptacles;

receiving a plurality of currency bills in an input receptacle;

transporting the bills with a transport mechanism, one at a time, from the input receptacle past an evaluating area to the plurality of output receptacles;

determining information concerning each of the bills with an evaluating unit;

designating the particular one of the plurality of output receptacles to which each of the bills are transported based on the determined information concerning each of the bills;

comparing the designated output receptacle for each of the bills to the disabled output receptacle; and re-designating the particular one of the plurality of output receptacles to which each of the bills are transported to an alternative output receptacle when the designated output receptacle is the disabled output receptacle.

18. The method of claim 17 further comprising detecting the presence of an error condition within the plurality of output receptacles.

19. The method of claim 18 wherein disabling further comprises disabling the output receptacle having an error condition detected therein.

20. The method of claim 19 wherein the currency handling device includes a user interface, and wherein disabling further comprises disabling the output receptacle having an error condition detected therein in response to user input.

21. The method of claim 17 further comprising receiving input from a user of the currency handling device selecting a mode of operation from a plurality of modes of operation stored within a memory of the currency handling device, wherein the mode of operation designates the one of the plurality of output receptacles to which each of the bills are transported based on the determined information concerning the bill.

22. The method of claim 21 wherein the alternative output receptacle is the output receptacle to which no call bills are transported pursuant to the selected mode of operation.

23. The method of claim 17 further comprising receiving input from a user of the currency handling device specifying the particular one of the plurality of output receptacles to be disabled.

24. The method of claim 17 further comprising receiving input from a user of the currency handling device specifying which of the plurality of output receptacles is the alternative output receptacle.

* * * * *